US008860543B2

(12) United States Patent
Schaffer et al.

(10) Patent No.: US 8,860,543 B2
(45) Date of Patent: Oct. 14, 2014

(54) WIRE-LESS INDUCTIVE DEVICES AND METHODS

(75) Inventors: Christopher P. Schaffer, Fallbrook, CA (US); Aurelio J. Gutierrez, Bonita, CA (US)

(73) Assignee: Pulse Electronics, Inc., San Diego, CA (US)

( * ) Notice: Subject to any disclaimer, the term of this patent is extended or adjusted under 35 U.S.C. 154(b) by 1415 days.

(21) Appl. No.: 11/985,156

(22) Filed: Nov. 13, 2007

(65) Prior Publication Data

US 2008/0186124 A1 Aug. 7, 2008

Related U.S. Application Data

(60) Provisional application No. 60/859,120, filed on Nov. 14, 2006.

(51) Int. Cl.
*H01F 5/00* (2006.01)

(52) U.S. Cl.
USPC ..... 336/200

(58) Field of Classification Search
USPC ..... 336/65, 192, 200, 220–223, 232, 336/205–208; 257/531
See application file for complete search history.

(56) References Cited

U.S. PATENT DOCUMENTS

| | | | | |
|---|---|---|---|---|
| 3,614,554 | A | 10/1971 | Shield et al. | |
| 4,253,231 | A | 3/1981 | Nouet | |
| 4,547,961 | A | 10/1985 | Bokil et al. | |
| 4,847,986 | A | 7/1989 | Meinel | |
| 5,038,104 | A | 8/1991 | Wikswo, Jr. et al. | |
| 5,055,816 | A | 10/1991 | Altman et al. | |
| 5,126,714 | A | 6/1992 | Johnson | |
| 5,257,000 | A | 10/1993 | Billings et al. | |
| 5,430,613 | A * | 7/1995 | Hastings et al. | 361/760 |
| 5,487,214 | A | 1/1996 | Walters | |
| 5,781,091 | A | 7/1998 | Krone et al. | |
| 5,959,846 | A * | 9/1999 | Noguchi et al. | 361/782 |
| 6,148,500 | A * | 11/2000 | Krone et al. | 29/602.1 |
| 6,440,750 | B1 | 8/2002 | Feygenson et al. | |
| 6,445,271 | B1 | 9/2002 | Johnson | |
| 6,455,885 | B1 | 9/2002 | Lin | |
| 6,642,827 | B1 | 11/2003 | McWilliams et al. | |
| 6,696,910 | B2 * | 2/2004 | Nuytkens et al. | 336/200 |
| 6,926,558 | B2 | 8/2005 | Sasai et al. | |
| 6,952,153 | B2 * | 10/2005 | Jacobson et al. | 336/200 |
| 7,109,837 | B2 | 9/2006 | Watts et al. | |
| 7,158,005 | B2 | 1/2007 | Pleskach et al. | |
| 7,196,607 | B2 | 3/2007 | Pleskach | |
| 7,271,697 | B2 | 9/2007 | Whittaker et al. | |

(Continued)

FOREIGN PATENT DOCUMENTS

| | | |
|---|---|---|
| CN | 1270332 | 8/2006 |
| EP | 0708459 A1 | 4/1996 |

*Primary Examiner* — Tuyen Nguyen
(74) *Attorney, Agent, or Firm* — Gazdzinski & Associates, PC

(57) ABSTRACT

A wire-less inductive device and methods of manufacturing and use are disclosed. In one embodiment, the inductive device comprises a plurality of through-hole vias which act to replace windings disposed around a magnetically permeable core. In another embodiment, the inductive device comprises a plurality of connection elements disposed or formed within channels which act as windings disposed around a magnetically permeable core. In a second aspect of the invention, a method of manufacturing the aforementioned inductive devices is disclosed. In a third aspect of the invention, an electronics assembly and circuit comprising the wire-less inductive devices are disclosed.

14 Claims, 20 Drawing Sheets

(56) References Cited

U.S. PATENT DOCUMENTS

| | | | | |
|---|---|---|---|---|
| 7,405,643 | B2 | 7/2008 | Jeong et al. | |
| 7,408,434 | B2 | 8/2008 | Lee et al. | |
| 7,477,128 | B2 | 1/2009 | Quilici et al. | |
| 7,656,263 | B2 * | 2/2010 | Whittaker et al. | 336/200 |
| 7,868,727 | B2 * | 1/2011 | Chen et al. | 336/200 |
| 8,203,418 | B2 * | 6/2012 | Harrison et al. | 336/200 |
| 8,234,778 | B2 * | 8/2012 | Schaffer et al. | 29/602.1 |
| 2002/0158305 | A1 | 10/2002 | Dalmia et al. | |
| 2003/0011458 | A1 | 1/2003 | Nuytkens et al. | |
| 2004/0000968 | A1 | 1/2004 | White et al. | |
| 2005/0088267 | A1 | 4/2005 | Watts | |
| 2005/0208914 | A1 | 9/2005 | Ogawa | |
| 2006/0176139 | A1 | 8/2006 | Pleskach et al. | |
| 2007/0001796 | A1 | 1/2007 | Waffenschmidt et al. | |
| 2007/0111598 | A1 | 5/2007 | Quilici | |
| 2009/0077791 | A1 | 3/2009 | Quilici | |
| 2010/0295646 | A1 | 11/2010 | Harrison et al. | |

* cited by examiner

WIRE-LESS INDUCTIVE DEVICES AND METHODS

PRIORITY

This application claims priority to U.S. provisional patent application Ser. No. 60/859,120 filed Nov. 14, 2006 entitled "WIRE-LESS INDUCTIVE DEVICES AND METHODS", which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to circuit elements and more particularly in one aspect to inductors or inductive devices having various desirable electrical and/or mechanical properties, and methods of utilizing and manufacturing the same.

DESCRIPTION OF RELATED TECHNOLOGY

A myriad of different configurations of inductors and inductive devices are known in the prior art. One common approach to the manufacture of efficient inductors and inductive devices is the use of a magnetically permeable toroidal core. Toroidal cores are very efficient at maintaining the magnetic flux of an inductive device constrained within the core itself. Typically these cores (toroidal or not) are wound with one or more magnet wire windings thereby forming an inductor or an inductive device. Prior art inductors and inductive devices are exemplified in a wide variety of shapes and manufacturing configurations.

For example, U.S. Pat. No. 3,614,554 to Shield, et al. issued Oct. 19, 1971 and entitled "Miniaturized Thin Film Inductors for use in Integrated Circuits" discloses thin film inductors for use with miniaturized integrated circuits that are fabricated by forming a first level of parallel metal strips on a substrate and then forming an insulating layer over the strips. A bar of magnetic material is disposed along the center portions of the metal strips and a layer of insulation is deposited over the bar of magnetic material. A second level of parallel metal strips is then formed over the layer of insulation and is connected between opposed ends of adjacent ones of metal strips at the first level to form a continuous flattened coil around the bar of magnetic material. In other embodiments of the invention, the bar of magnetic material may be omitted, or may be disposed outside the continuous flattened coil formed by the metal strips.

U.S. Pat. No. 4,253,231 to Nouet issued Mar. 3, 1981 and entitled "Method of making an inductive circuit incorporated in a planar circuit support member" discloses a planar support member for an electric circuit, e.g. a printed circuit board, wherein at least a region of the support member includes magnetic material through at least a part of its thickness. A magnetic circuit is made in this material by forming at least one opening through it. The support member is then coated with insulative material and conductor paths are made on both faces of the support member by conventional techniques for such members. These paths include a winding disposed around a core part of the magnetic circuit with alternate half turns being formed on opposite faces and interconnected by through plating. The inductive circuit thus formed may constitute an inductor, a transformer or a relay.

U.S. Pat. No. 4,547,961 to Bokil, et al. issued Oct. 22, 1985 and entitled "Method of manufacture of miniaturized transformer" discloses a miniaturized thick-film isolation transformer comprising two rectangular substrates each carrying successive screen-printed thick-film layers of dielectric with spiral planar windings embedded therein. The spiral windings comprise conductors formed of fused conductive particles embedded within a layer of dielectric insulating means solidified by firing at high temperature to form a rigid structure with the windings hermetically sealed within the dielectric and conductively isolated from each other within the transformer. The substrates are formed at opposite ends thereof with closely adjacent connection pads all located at a single level to accommodate automated connection making. Connections between the pads and the windings are effected by conductors formed of fused conductive particles. The substrates and the dielectric layers are formed with a central opening in which is positioned the central leg of a three-legged solid magnetic core. The remaining portions of the core surround the two substrates to form a compact rugged construction especially suitable for assembly with hybrid integrated circuit components.

U.S. Pat. No. 4,847,986 to Meinel issued Jul. 18, 1989 and entitled "Method of making square toroid transformer for hybrid integrated circuit" discloses a square toroid transformer that is assembled on a ceramic hybrid integrated circuit substrate. The primary and secondary windings of the transformer are provided on opposite arms of a square toroid ferrite core by providing first and second groups of spaced, parallel metal conductors on the surface of the ceramic substrate and adherent thereto, and an insulative layer over the first and second groups of conductors, leaving their respective end portions exposed. The square toroid ferrite core, coated with dielectric material, is attached to the insulative layer. Wire bonds in planes perpendicular to the longitudinal axes of the opposite arms each are wire bonded, respectively, to an inner end of one of the metal conductors and an outer end of an adjacent one. A large number of turns for both the primary winding and the secondary winding are achieved, resulting in high primary and secondary winding and inductances, while maintaining a uniform separation and high breakdown voltage between the primary and secondary wirings.

U.S. Pat. No. 5,055,816 to Altman, et al. issued Oct. 8, 1991 and entitled "Method for fabricating an electronic device" discloses a method of fabricating an electronic device on a carrier wherein the method comprises forming a hole pattern in the carrier, and providing a metallization pattern on the carrier, and through the holes to define the electronic device.

U.S. Pat. No. 5,126,714 to Johnson issued Jun. 30, 1992 and entitled "Integrated circuit transformer" discloses an integrated circuit transformer which is constructed in a laminar hion. The disclosed invention includes a bottom plate with cores protruding from its upper surface and a top plate with several feed through holes. Both plates are made from high permeability magnetic material. Interposed between the top and bottom plates are at least one primary and at least one secondary. The primary has feed through holes, vertically aligned with the feed through holes in the top, holes to allow the cores to protrude through, and tabs for connecting to the input circuit. The primary is made of a laminate clad with an electrical conductor. The circuit which conducts the current around the cores is fabricated by etching special patterns of insulative gaps into the electrical conductor. The secondary has holes to allow the cores to protrude through. It also is made of a laminate clad with an electrical conductor. And again, the circuit which conducts the current around the cores is fabricated by etching a special pattern of insulative gaps into the electrical conductor. The output circuit is connected to the secondary at three connection points. These points are accessible through the feed through holes and access holes. The primary and secondary may be fabricated as a sub-assembly by multiple layer printed circuit techniques. More than one primary and secondary may be utilized in the integrated transformer. The transformer may be embodied as a current, a voltage or a power transformer.

U.S. Pat. No. 5,257,000 to Billings, et al. issued Oct. 26, 1993 and entitled "Circuit elements dependent on core inductance and fabrication thereof" discloses magnetic circuit elements, e.g. for inclusion on circuit boards including one or more windings about a toroidal core that are produced by joinder of mating sheets, one or both recessed to hold the core, and each containing partial windings. Joinder is by use of an anisotropically conducting adhesive layer. The layer is applied as an uncured thermosetting adhesive containing spherical conducting particles of such size and distribution as to statistically result in electrical completion of windings while avoiding turn-to-turn shorting.

U.S. Pat. No. 5,487,214 to Walters issued Jan. 30, 1996 and entitled "Method of making a monolithic magnetic device with printed circuit interconnections" discloses a monolithic magnetic device having a plurality of transformer elements having single turn primaries and single turn secondaries fabricated on a plate of ferrite which has the outline of a ceramic leadless chip carrier. Each of the magnetic elements has a primary winding formed from a copper via plated on the ferrite. Each element's secondary is another copper via plated over an insulating layer formed over the first layer of copper. The elements' primaries are interconnected on the first copper layer and the elements' secondaries are interconnected on the second copper layer. The configuration and turns ratio of the transformer are determined by the series and or parallel interconnections of the primary and secondaries. Some of the interconnections can be provided by the next higher assembly level through the circuit card, with the same magnetic device providing many turns ratio combinations or values of inductors.

U.S. Pat. No. 5,781,091 to Krone, et al. issued Jul. 14, 1998 and entitled "Electronic inductive device and method for manufacturing" discloses inductive electrical components fabricated by PWB techniques of ferromagnetic core or cores that are embedded in an insulating board provided with conductive layers. Conductive through-holes are provided in the board on opposite sides of a core. The conductive layers are patterned to form with the conductive through-holes one or more sets of conductive turns forming a winding or windings encircling the core. The conductive layers can also be patterned to form contact pads on the board and conductive traces connecting the pads to the windings.

U.S. Pat. No. 6,440,750 to Feygenson, et al. issued Aug. 27, 2002 and entitled "Method of making integrated circuit having a micromagnetic device" discloses a method of manufacturing an integrated circuit and an integrated circuit employing the same. In one embodiment, the method of manufacturing the integrated circuit includes (1) conformally mapping a micromagnetic device, including a ferromagnetic core, to determine appropriate dimensions therefore, (2) depositing an adhesive over an insulator coupled to a substrate of the integrated circuit and (3) forming the ferromagnetic core of the appropriate dimensions over the adhesive.

U.S. Pat. No. 6,445,271 to Johnson issued Sep. 3, 2002 and entitled "Three-dimensional micro-coils in planar substrates" discloses a three-dimensional micro-coil situated in a planar substrate. Two wafers have metal strips formed in them, and the wafers are bonded together. The metal strips are connected in such a fashion to form a coil and are encompassed within the wafers. Metal sheets are formed on the facing surfaces of the wafers to result in a capacitor. The coil may be a single or multi-turn configuration. It also may have a toroidal design with a core volume created by etching a trench in one of the wafers before the metal strips for the coil are formed on the wafer. The capacitor can be interconnected with the coil to form a resonant circuit. An external circuit for impedance measurement, among other things, and a processor may be connected to the micro-coil chip.

United States Patent Publication No. 20060176139 to Pleskach; et al. published Aug. 10, 2006 and entitled "Embedded toroidal inductor" discloses a toroidal inductor, including a substrate, a toroidal core region defined within the substrate, and a toroidal coil including a first plurality of turns formed about the toroidal core region and a second plurality of turns formed about the toroidal core region. The second plurality of turns can define a cross sectional area greater than a cross sectional area defined by the first plurality of turns. The substrate and the toroidal coil can be formed in a co-firing process to form an integral substrate structure with the toroidal coil at least partially embedded therein. The first and second plurality of turns can be disposed in alternating succession. The toroidal core region can be formed of a substrate material having a permeability greater than at least one other portion of the substrate.

United States Patent Publication No. 20060290457 to Lee; et al. published Dec. 28, 2006 and entitled "Inductor embedded in substrate, manufacturing method thereof, micro device package, and manufacturing method of cap for micro device package" discloses an inductor embedded in a substrate, including a substrate, a coil electrode formed by filling a metal in a spiral hole formed on the substrate, an insulation layer formed on the substrate, and an external connection pad formed on the insulation layer to be connected to the coil electrode. The inductor-embedded substrate can be used as a cap for a micro device package by forming a cavity on its bottom surface.

United States Patent Publication No. 20070001796 to Waffenschmidt; et al. published Jan. 4, 2007 and entitled "Printed circuit board with integrated inductor" discloses a printed circuit board with an integrated inductor. A core of an inductor may be realized by ferrite plates glued onto a substrate. A winding of the inductor is provided in the substrate.

United States Patent Publication No. 20070216510 to Jeong; et al. published Sep. 20, 2007 and entitled "Inductor and method of forming the same" discloses an inductor pattern that is formed on a substrate. A conductive pattern having a concave-convex structure is formed on the inductor pattern to increase a surface area of the inductor pattern. An insulation layer is formed on the inductor pattern. After a groove is formed such that the insulation layer is removed to expose the inductor pattern, a conductive pattern is conformally formed on the groove and the insulation layer. Thus, a surface area of the inductor pattern as well as a thickness of an inductor increases to obtain an inductor of a high quality factor.

However, despite the broad variety of prior art inductor configurations, there is a salient need for inductive devices that are both: (1) low in cost to manufacture; and (2) offer improved electrical performance over prior art devices. Ideally such a solution will not only offer improved electrical performance for the inductor or inductive device, but such a solution will also ideally provide greater consistency between devices manufactured in mass production. Such a solution should also increase consistency and reliability of performance by limiting opportunities for manufacturing errors of the device.

SUMMARY OF THE INVENTION

In a first aspect of the invention, an improved wire-less toroidal inductive device is disclosed. In one embodiment, the inductive device comprises a plurality of through-hole vias with these vias acting as portions of windings disposed around a magnetically permeable core. Traces located on conductive layers of a substrate are then printed to complete the windings. In another embodiment, the inductive device comprises a plurality of connection inserts which act as portions of windings disposed around a magnetically permeable core. In yet another embodiment, the wire-less toroidal inductive device is self-leaded. In yet another embodiment, mounting locations for electronic components are supplied on the aforementioned inductive device.

In another embodiment, the wire-less inductive device comprises: a plurality of substrates, said substrates having one or more windings formed thereon; and a magnetically permeable core, the core disposed at least partly between the plurality of printable substrates.

In a second aspect of the invention, a method of manufacturing the aforementioned inductive devices are disclosed. In one embodiment, the method comprises: forming a plurality of conductive pathways on both a first and a second substrate; disposing a core at least partly between the first and second substrates; and joining the first and second substrates including respective ones of the pathways, thereby forming the inductive device.

In a third aspect of the invention, an electronics assembly and circuit comprising the wire-less toroidal inductive device are disclosed.

In a fourth aspect of the invention, an improved wire-less non-toroidal inductive device is disclosed. In one embodiment, the non-toroidal inductive device comprises a plurality of through-hole vias which act as portions of windings disposed around a magnetically permeable core. Printed windings located on conductive layers of a substrate are then printed to complete the windings. In another embodiment, the inductive device comprises a plurality of connection inserts which act as portions of windings disposed around a magnetically permeable core. In yet another embodiment, the wire-less non-toroidal inductive device is self-leaded. In yet another embodiment, mounting locations for electronic components are supplied on the aforementioned inductive device.

In a fifth aspect of the invention, a method of manufacturing the aforementioned non-toroidal inductive device is disclosed. In one embodiment, the method comprises: disposing winding material onto a first and second substrate header; disposing a core at least partly between the first and second headers; and joining the first and second headers thereby forming the wire-less inductive device.

In a sixth aspect of the invention, an electronics assembly and circuit comprising the wire-less non-toroidal inductor is disclosed.

In a seventh aspect, an inductive device is disclosed. In one embodiment, the device comprises: a plurality of substrates, the substrates having one or more conductive pathways formed therein; and a magnetically permeable core, the core disposed at least partly between the plurality of printable substrates.

In another embodiment, the device comprises: at least two substantially insulating elements, the elements each having a plurality of conductive pathways formed therein, and at least one of the elements comprising a recess adapted to receive a magnetically permeable core; and a magnetically permeable core, the core disposed at least partly between the plurality of elements and at least partly within the recess. The conductive pathways of the at least two elements are in electrical communication so as to form one or more continuous electrical pathways throughout the inductive device.

In an eighth aspect of the invention, a multiple core inductive device is disclosed. In one embodiment, the device comprises: a plurality of substrates, the substrates having a plurality of conductive pathways; and a plurality of magnetically permeable cores, the plurality of cores each disposed at least partly between the plurality of printable substrates.

In a ninth aspect of the invention, a system for providing an inductive device on an external substrate is disclosed. In one embodiment, the system comprises: a substrate header comprising: a cavity; and one or more windings comprising at least one trace disposed on at least one surface of the substrate header and a plurality of conductive vias disposed within the substrate header and in electrical communication with the at least one trace; a magnetic core disposed within the cavity; and an external substrate. The external substrate further may comprise at least one external substrate trace, the at least one external substrate trace in electrical communication with the plurality of conductive vias thereby forming an inductive device.

BRIEF DESCRIPTION OF THE DRAWINGS

The features, objectives, and advantages of the invention will become more apparent from the detailed description set forth below when taken in conjunction with the drawings, wherein.

Figure 1:
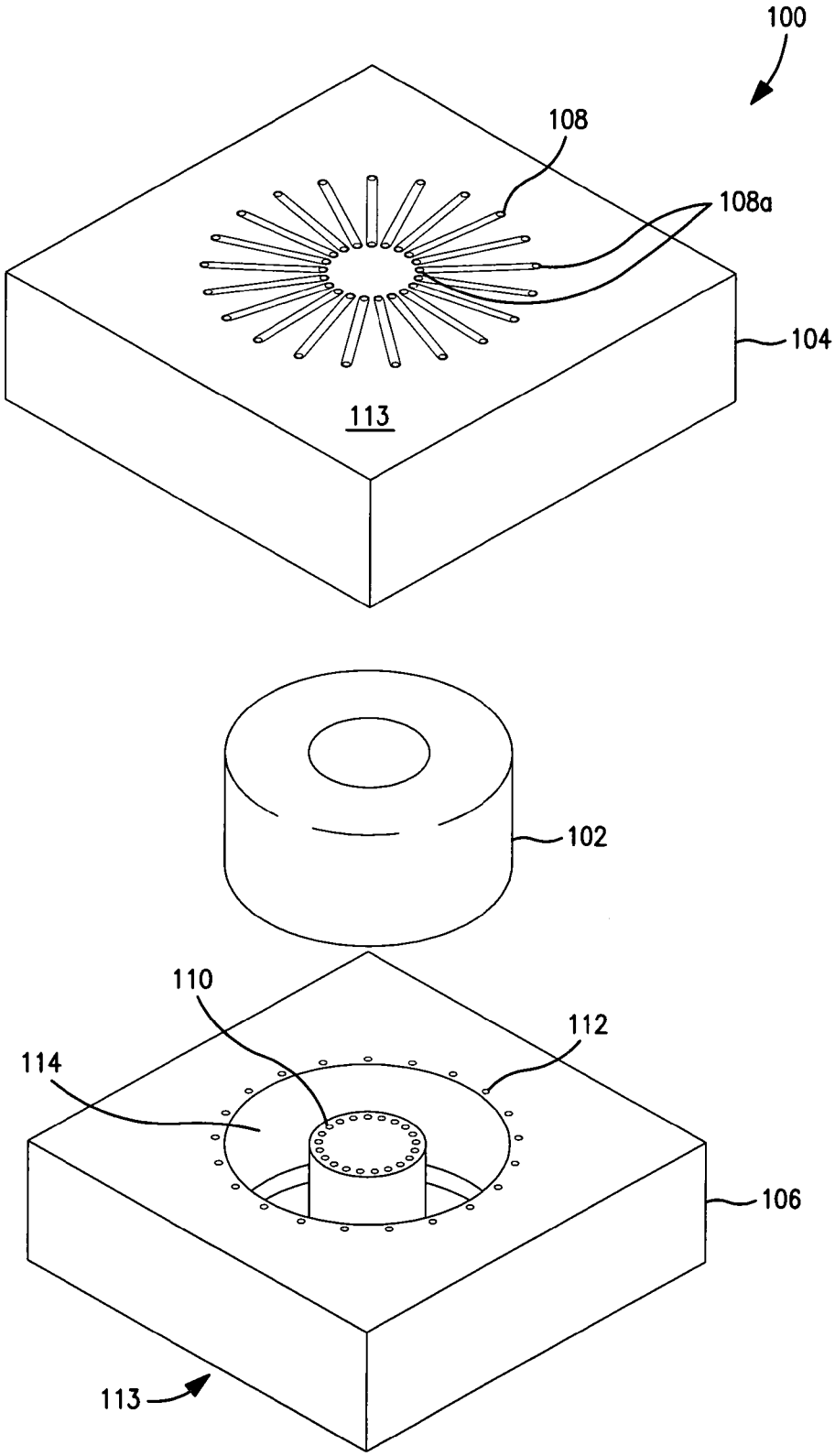
FIG. 1 is a front perspective exploded view illustrating a first embodiment of a wire-less toroidal inductor manufactured in accordance with the principles of the present invention.

All Figures disclosed herein are © Copyright 2006-2007 Pulse Engineering, Inc. All rights reserved.

DETAILED DESCRIPTION OF THE PREFERRED EMBODIMENT

Reference is now made to the drawings wherein like numerals refer to like parts throughout.

As used herein, the term "integrated circuit" shall include any type of integrated device of any function, whether single or multiple die, or small or large scale of integration, including without limitation applications specific integrated circuits (ASICs), field programmable gate arrays (FPGAs), digital processors (e.g., DSPs, CISC microprocessors, or RISC processors), and so-called "system-on-a-chip" (SoC) devices.

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, and diodes, whether discrete components or integrated circuits, whether alone or in combination.

As used herein, the term "magnetically permeable" refers to any number of materials commonly used for forming inductive cores or similar components, including without limitation various formulations made from ferrite.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

Overview

The present invention provides, inter alia, improved low cost inductive apparatus and methods for manufacturing, and utilizing, the same.

In the electronics industry, as with many industries, the costs associated with the manufacture of various devices are directly correlated to the costs of the materials, the number of components used in the device, and/or the complexity of the assembly process. Therefore, in a highly cost competitive environment such as the electronics industry, the manufacturer of electronic devices with designs that minimize cost (such as by minimizing the cost factors highlighted above) will maintain a distinct advantage over competing manufacturers.

One such device comprises those having a wire-wound magnetically permeable core. These prior art inductive devices, however, suffer from electrical variations due to, among other factors: (1) non-uniform winding spacing and distribution; and (2) operator error (e.g., wrong number of turns, wrong winding pattern, misalignment, etc.). Further, such prior art devices are often incapable of efficient integration with other electronic components, and/or are subject to manufacturing processes that are highly manual in nature, resulting in higher yield losses and driving up the cost of these devices.

The present invention seeks to minimize costs by, inter alia, eliminating these highly manual prior art processes (such as manual winding of a toroid core), and improving electrical performance by offering a method of manufacture which can control e.g. winding pitch, winding spacing, number of turns, etc. automatically and in a highly uniform fashion. Hence, the present invention provides apparatus and methods that not only significantly reduce or even eliminate the "human" factor in precision device manufacturing (thereby allowing for greater performance and consistency), but also significantly reduce the cost of producing the device.

In one exemplary embodiment, an improved "wire-less" inductive device is disclosed. The inductive device comprises a header element having a plurality of through-hole vias which, when completed, act as portions of windings disposed around a magnetically permeable core. Printed (etched) winding portions are also applied onto the header, thereby completing the "windings" disposed around a magnetically permeable core.

In another embodiment, the inductive device comprises a plurality of connection channels which replace the through-hole vias of the embodiment discussed above. One variant disposes an electro-platable material into each channel, thereby allowing for a conductive path to form within the channel at a desired location.

In yet another aspect, the wire-less inductive devices described above may be self-leaded, and further have the capability to have other electronic components mounted directly thereon.

Wire-Less Toroidal Inductive Devices

Referring now to FIG. 1, a first exemplary embodiment of the present invention is shown and described in detail. It will be recognized that while the following discussion is cast in terms of an inductor, the invention is equally applicable to other inductive devices (including without limitation choke coils, inductive reactors, transformers, filters, and the like). These and other applications will be discussed more fully herein below.

In the embodiment of FIG. 1, this inductive device 100 comprises a magnetically permeable toroidal core 102 and two wire-less substrate headers 104, 106. As previously alluded to, the term wire-less refers to the fact that the inductive device 100 of the present invention does not require magnet or similar wire windings disposed about a toroidal core, and not to a complete obviation of any sort of windings. The present embodiment incorporates its windings onto one or more printable and/or etchable substrate headers thereby providing many advantages over wire wound prior art devices which will be discussed more fully herein below.

The toroidal core 102 of the present embodiment is of the type ubiquitous in the art. The toroidal core 102 may optionally be coated using well known coatings such as a parylene in order to improve, inter alia, isolation between the core and any adjacent windings. In addition, the toroidal core 102 may optionally be gapped (whether in part or completely) in order to improve the saturation characteristics of the core. These and other optional core configurations are disclosed in, for example, co-owned U.S. Pat. No. 6,642,827 entitled "Advanced electronic microminiature coil and method of manufacturing" issued Nov. 4, 2003, the contents of which are incorporated by reference herein in their entirety. Other toroidal core embodiments could also be readily utilized consistent with the present invention including, inter alia, those shown in and described with respect to FIGS. 13-16 of co-owned U.S. Pat. No. 7,109,837 entitled "Controlled inductance device and method" issued Sep. 19, 2006, the contents of which are incorporated by reference herein in their entirety. Moreover, the embodiments shown in FIGS. 17a-17f of co-owned and co-pending U.S. application Ser. No. 10/882,864 entitled "Controlled inductance device and method" filed Jun. 30, 2004 and incorporated herein by reference may be used consistent with the invention, such as for example wherein one or more "washers" are disposed within one or more of the headers 104, 106. Myriad other configurations will be appreciated by those of ordinary skill given the present disclosure and those previously referenced.

The top header 104 of the device 100 may optionally comprise a circuit printable material such as, without limitation, a ceramic substrate (e.g. Low Temperature Co-fired Ceramic, or "LTCC"), a composite (e.g., graphite-based) material, or a fiberglass-based material ubiquitous in the art such as FR-4. Fiberglass based materials have advantages over LTCC in terms of cost and world-wide availability; however LTCC has advantages as well. Specifically, LTCC technology presents advantages in that the ceramic can be fired below a temperature of approximately 900° C. due to the special composition of the material. This permits the co-firing with other highly conductive materials (i.e. silver, copper, gold and the like). LTCC also permits the ability to embed passive elements, such as resistors, capacitors and inductors into the underlying ceramic package. LTCC also has advantages in terms of dimensional stability and moisture absorption over many fiberglass-based or composite materials, thereby providing a dimensionally reliable base material for the underlying inductor or inductive device.

The top header 104 of the illustrated embodiment comprises a plurality of windings 108 printed or otherwise disposed directly on the top header 104 using, e.g., well known printing or stenciling techniques. While the present embodiment incorporates a plurality of printed windings 108, the invention is in no way so limited. For example, a single winding turn may readily be used if desired.

The ends 108*a* of each winding 108 in the present embodiment advantageously comprise a plated through-hole adapted to electrically (and physically) interface with a respective via 110, 112 located on the bottom header 106. However, alternate embodiments are discussed subsequently herein with regards to FIGS. 2-2*a* that illustrate alternate configurations that do not require a traditional via.

Each winding 108 of the top header 104 can be printed with a high degree of placement accuracy, which is a first salient advantage over magnet-wire wound inductors commonly used in the prior art. Because these windings located on both the top 104 and bottom 106 header portions are printed or otherwise disposed using highly controlled processes, the spacing and/or pitch of the windings can be controlled with a very high degree of accuracy, thereby providing electrical performance uniformity that is unmatched by prior art wire-wound inductive devices.

It will also be recognized that the term "spacing" may refer to the distance of a winding from the outer surface of the core, as well as the winding-to-winding spacing or pitch. Advantageously, the illustrated device 100 very precisely controls the spacing of the "windings" (vias and printed header portions) from the core 102, since the cavity 114 formed in the headers 104, 106 is of precise placement and dimensions relative to the vias and outer surfaces of the headers. Hence, windings will not inadvertently be run atop one another, or have undesired gaps formed between them and the core due to, e.g., slack in the wire while it is being wound, as may occur in the prior art.

Similarly, the thickness and dimensions of each winding portion 108 can be very precisely controlled, thereby providing advantages in terms of consistent electrical parameters (e.g., electrical resistance or impedance, eddy current density, etc.). Hence, the characteristics of the underlying manufacturing process result in highly consistent electrical performance across a large number of devices. For example, under solutions available in the prior art, electrical characteristics such as interwinding capacitance, leakage inductance, etc. would be subject to substantial variations due to the manual and highly variable nature of prior art winding processes. In certain applications, these prior art winding processes have proved notoriously difficult to control. For instance, across large numbers of manufactured inductive devices, it has proven difficult to consistently regulate winding pitch (spacing) in mass production.

Further, the present embodiment of the inductive device 100 has advantages in that the number of turns is also precisely controlled by the header configuration and the use of an automated printing process, thereby eliminating operator dependent errors that could result in e.g. the wrong number of turns being applied to the core.

While in numerous prior art applications, the aforementioned variations proved in many cases not to be critical, with ever-increasing data rates being utilized across data networks, the need for more accurate and consistent electrical performance across inductive devices has become much more prevalent. While customer demands for higher performance electronic components has steadily increased in recent years, these requirements have also been accompanied by increasing demands for lower cost electronic components. Hence, it is highly desirable that any improved inductive device not only improve upon electrical performance over prior art wire-wound devices, but also provide customers with a cost-competitive solution. The automated processes involved in the manufacture of the inductive device 100 are in fact cost competitive with prior art wire-wound inductive devices. These automated manufacturing processes are discussed in greater detail subsequently herein with regards to exemplary methods of manufacture and FIGS. 4*a*-4*b*.

The present invention further allows for physical separation of the windings and the toroid core, so that the windings are not directly in contact with the core, and variations due to overwinding of other turns, etc. are avoided. Moreover, damage to the toroid (including the coatings such as parylene) is avoided since no conventional windings are wound onto the core, thereby avoiding cuts by the wire into the surface of the toroid or its coating. The exemplary embodiment also physically decouples the toroid core 102 from the headers 104, 106 and the winding portions 108 such that the two components can be separated or treated separately.

Conversely, the use of a "separated" winding and toroid may obviate the need for additional components or coatings in some instances. For example, there may be no need for a parylene coating, silicone encapsulant, etc. in the exemplary embodiment (as are often used on prior art wire-wound devices), since the relationship between the windings and the core is fixed, and these components separated.

The present invention also affords the opportunity to use multi-configuration headers. For example, in one alternative embodiment, the headers 104, 106 can be configured with N vias, such that a device utilizing all N vias for "windings" can be formed therefrom, or a device with some fraction of N (e.g., N/2, N/3, etc.) windings formed. In the exemplary case, when forming the N/2 winding device, the unused holes or vias advantageously require no special treatment during manufacture. Specifically, they can be plated the same as the via to be used for windings, yet simply not "connected-up" on the header outer surfaces 113. Alternatively, if N windings are desired, all of the vias (which are plated under either circumstance) are connected-up as shown in FIG. 1.

Referring back to FIG. 1, the bottom header 106 comprises outer winding vias 112 and inner winding vias 110 which are electrically interconnected via winding portions (not shown) similar to those seen with regards to the top header 104 (i.e. winding portions 108). A cavity 114 in the bottom header 106 is adapted to receive at least a portion the toroidal core 102. Hence, by receiving the core 102 in the cavity 114, the winding vias 112, 110 in combination with the windings 108 of the upper header 104 surround the core 102, thereby mimicking a prior art wire wound inductor or inductive device.

It will be appreciated that the cavity 114 may be disposed in either or both of the top and bottom headers 104, 106 as desired. For example, in one embodiment, the two headers comprise substantially identical components that each comprise a cavity adapted to receive approximately one-half of the toroid (vertically). In another embodiment, the toroid is completely received within one of the headers 104, 106, and the other has no cavity at all (effectively comprising a flat plate). In still another embodiment, the two headers each have a cavity, but the depth of each is different from the other.

In yet another embodiment, a multiplicity (e.g., three or more) of header elements (not shown) may be stacked in order to form an enclosure for the core(s). For example, in one variant, a top, middle and bottom header are used to form the toroid core enclosure.

Moreover, it will be appreciated that the materials used for the header components need not be identical, but rather may be heterogeneous in nature. For example, in the case of the "flat top header" previously described, the top header may actually comprises a PCB or other such substrate (e.g., FR-4), while the lower header comprises another material (e.g., LTCC, etc.). This may be used to reduce manufacturing costs and also allow for placement of other electronic components (e.g., passive devices such as resistors, capacitors, etc.) to be readily disposed thereon.

Figure 1A:
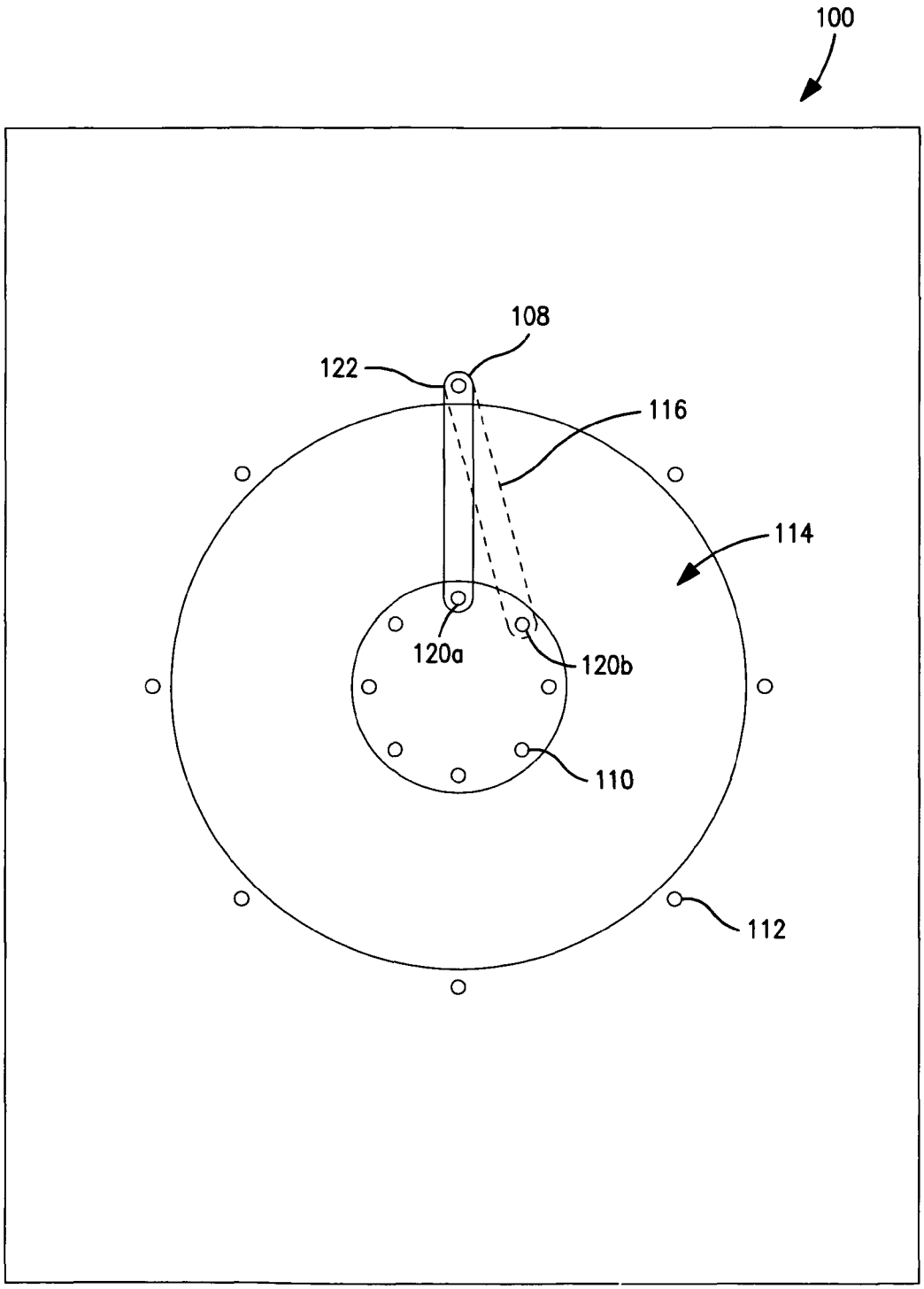
FIG. 1*a* is a top view demonstrating the routing of trace and via windings of the device of FIG. 1 in accordance with the principles of the present invention.

Referring now to FIG. 1*a*, the routing of conductive traces in order to construct windings about the toroidal core 102 is shown and described in detail. FIG. 1*a* shows a top view of the inductive device 100 of FIG. 1. Specifically, FIG. 1*a* shows a winding 108 on the top header 104 routed to a bottom winding 116 that is resident on the bottom header 106. As is demonstrated by FIG. 1*a*, a first via 120*a* routes a first winding 108 to a second via 122. The second via 122 then is connected via bottom winding 116 to a third via 120*b*. While only a single turn is shown, it can be seen that the aforementioned pattern may be repeated as necessary in order to complete a multiple turn inductive device 100 such as that shown in FIG. 1. In addition, while the present discussion is described with regards to top 104 and bottom 106 headers, the present embodiment is not so limited. In fact, three (3) or more headers may readily be utilized consistent with the principles of the present invention. Such an application for these three or more headers can be found, inter alia, in the embodiments incorporating twisted pair windings such as that shown in FIG. 1*g* below.

In addition, certain embodiments could readily incorporate a single header. Substantively, a single header device would require appropriate layout of the connection windings for the vias of the single header on the customer's printed circuit board. Such an embodiment is discussed more fully with regards to FIG. 1*h* below.

Figure 1B:
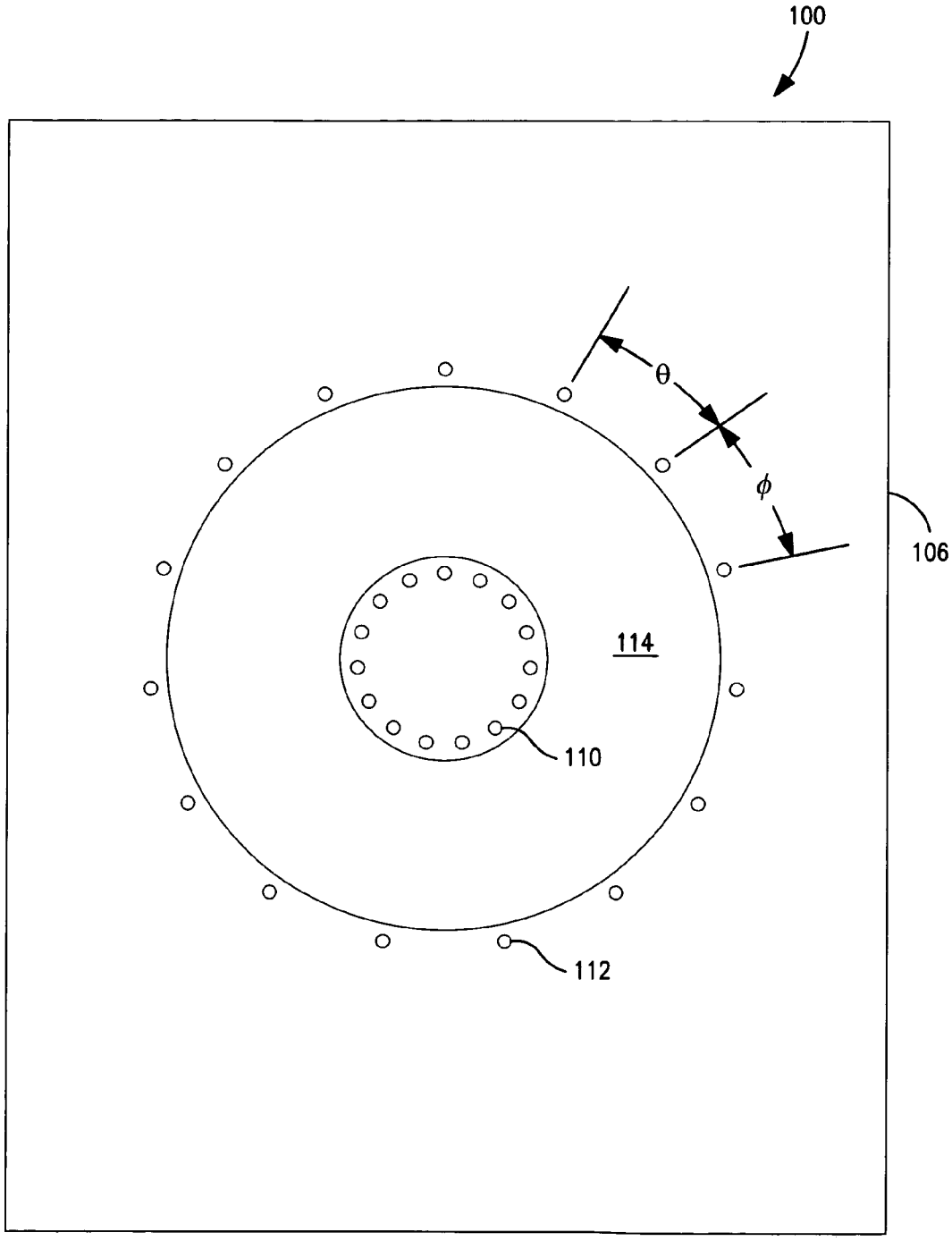
FIG. 1*b* is a top view of the bottom header of the inductive device of FIG. 1 manufactured in accordance with the principles of the present invention.

Referring now to FIG. 1*b*, another salient advantage of the inductive device 100 of the present embodiment is described. Looking down from the top at the bottom header 106, a plurality of connection vias 110, 112 corresponding to the inner and outer diameter of the cavity 114, respectively result in a defined angular spacing. As previously discussed, controlling the angular spacing between windings is, in certain applications, critical to the proper operation of the inductor or inductive device. As shown in FIG. 1*b*, three (3) sets of vias are shown which define angular spacings of θ and ϕ, respectively. Hence, another salient advantage of the inductive device 100 of the present invention over the prior art wire wound devices is that these angular spacings, θ and ϕ, can be tightly controlled according to any number of representative functions, such as those shown in equations (1) through (3).

$$\text{angle } \theta = \text{angle } \phi; \quad \text{Eqn. (1)}$$

$$\text{angle } \theta < \text{angle } \phi; \text{ and} \quad \text{Eqn. (2)}$$

$$\text{angle } \theta > \text{angle } \phi \quad \text{Eqn. (3)}$$

Hence, literally any number of predefined angular spacings may be utilized consistent with the principles of the present invention, unlike the prior art wire-wound approaches. Such ability to control spacing and disposition of the windings allows for control of the electrical and/or magnetic properties of the device (such as where the toroid is gapped, and the placement of the windings relative to the gap can be used to control flux density, etc.).

Figure 1C:
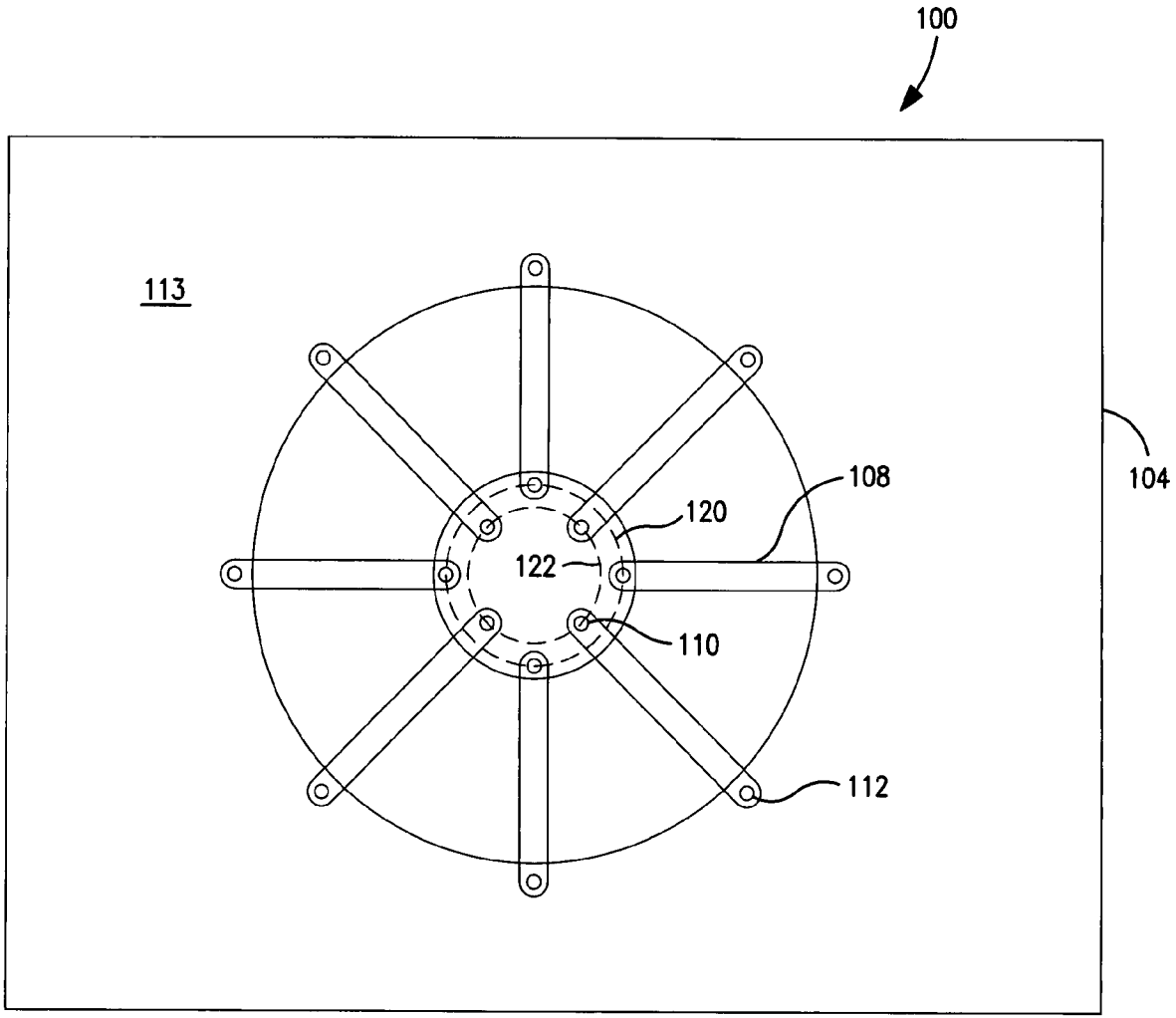
FIG. 1*c* is a top view of a second exemplary embodiment of an inductive device manufactured in accordance with the principles of the present invention.

Referring now to FIG. 1*c*, another exemplary configuration for the windings 108 of an inductive device 100 is shown and described in detail. As can be seen in FIG. 1*c*, the "inner" vias 110 are defined by a first inner diameter 120 and a second inner diameter 122. One advantage of such a configuration is that spacing between the inner vias 110 (i.e. between adjacent vias) can be increased in order to accommodate smaller diameter toroidal cores. This increased adjacent spacing is a direct result of the offset between the inner 122 and outer 120 diameters for the inner vias 110. While primarily envisioned as a means for increasing adjacent spacing on the inner diameter vias 110, it is noted that the principles are equally applicable to the outer vias 112 or for reasons other than increasing the adjacent spacing of the vias, such as for instance improving various electrical performance characteristics (i.e. cross talk and the like).

Figure 1D:
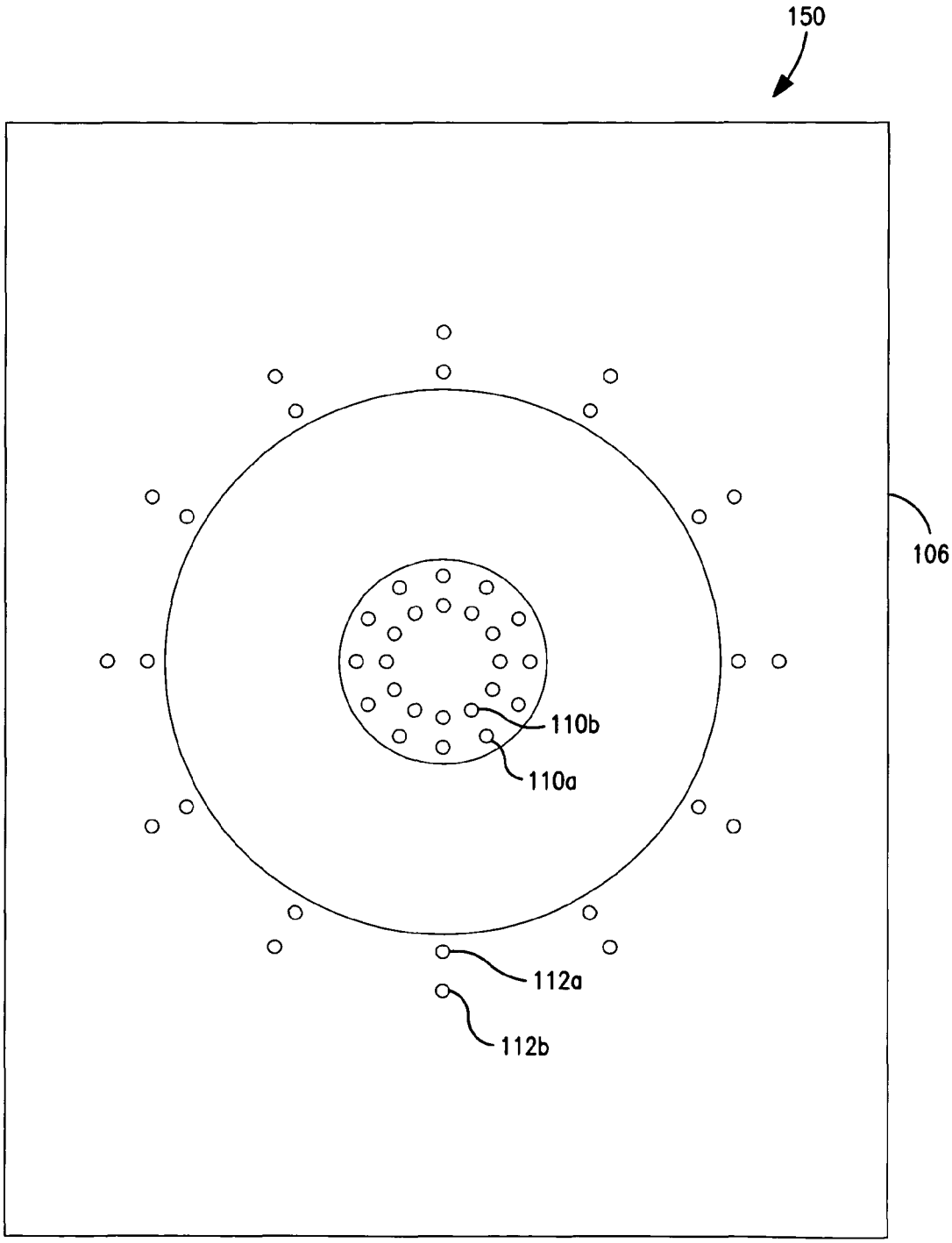
FIG. 1*d* is a top view of a first exemplary embodiment of a bottom header of a multiple winding inductive device manufactured in accordance with the principles of the present invention.
Figure 1E:
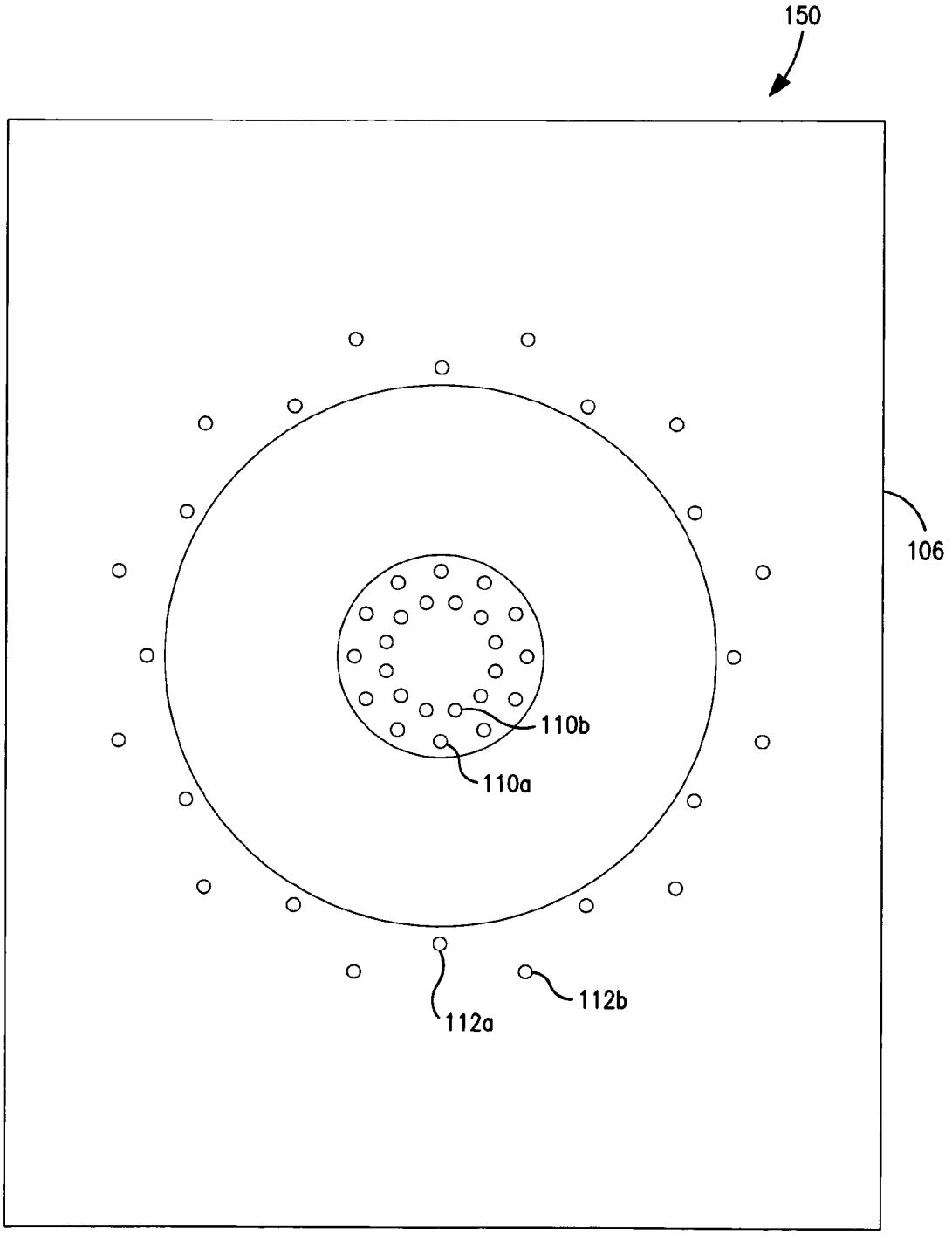
FIG. 1*e* is a top view of a second exemplary embodiment of a bottom header of a multiple winding inductive device manufactured in accordance with the principles of the present invention.

While a single winding inductive device 100 has been primarily shown and described, the principles of the present invention are equally applicable to multiple winding embodiments 150 such as those shown in FIGS. 1*d* and 1*e*.

Referring now to FIG. 1*d*, a top view of a bottom header 106 for a multiple turn inductive device 150 is shown and described in detail. Specifically, a primary winding is defined by vias 110*a*, 112*a*, while a secondary winding is defined by vias 110*b*, 112*b*. As would be appreciated by one of ordinary skill, the windings for the aforementioned inductive device 150 shown in FIG. 1*d* could use a multiple layer printed substrate (not shown) in order to run traces between the inner 110 and outer 112 vias located on the bottom header 106, since the first and second windings are radially aligned and/or the resultant trace windings could be, in certain high-density applications, prohibitively close to one another in the device shown in FIG. 1*d*. However, use of a single layer process e.g., with very fine routed traces, can be used consistent with the invention in cases where sufficient space on the single substrate surface is available.

Further, while two sets of winding vias are shown in the embodiment of FIG. 1*d*, it is recognized that three (3) or more windings could be employed equally as well.

In addition, similar to the discussion of angular and adjacent spacing of vias with regards to FIGS. 1*b* and 1*c* above, those principles may be readily incorporated into a multiple winding inductive device 150 such as that shown in FIG. 1*d*. One alternative embodiment demonstrating these principles is shown with regards to the embodiment of FIG. 1*e*.

Referring to FIG. 1*e*, a second embodiment of a multiple winding inductive device 150 is shown and described in detail. In the embodiment of the device 150 of FIG. 1*e*, the first and second windings, defined by vias 110*a*, 112*a* and 110*b*, 112*b* respectively, are no longer radially aligned but rather have angular offsets between the first 110*a*, 112*a* and second 110*b*, 112*b* sets of vias. Hence, the windings which interconnect the inner 110 and outer 112 vias may readily be routed on a single layer if desired. In considering whether a single or multi-layer printed substrate is desirable, several considerations may be taken into account. A first latent consideration is cost, with single layer substrates traditionally lower in cost than multiple layer substrates. Second, considerations such as electrical performance must also be taken into account for e.g. accounting for cross-talk, capacitive coupling, and/or electrical isolation and the like. Third, the geometry of the underlying device 150 must be taken into account, i.e. the geometry/size of the device 150 must be accommodated for in order to determine whether a single layer configuration can accommodate the number of windings required for any given application.

Note also that while the previous discussion of inductive devices 100, 150 has been directed to the use of a top 104 and a bottom header 106, the present invention is not so limited. In fact, three (3) or more headers could be utilized consistent with the principles of the present invention. One such application for three (3) or more headers may be found with regards to the embodiment shown in FIG. 1*g*, which is discussed more fully below.

Figure 1F:
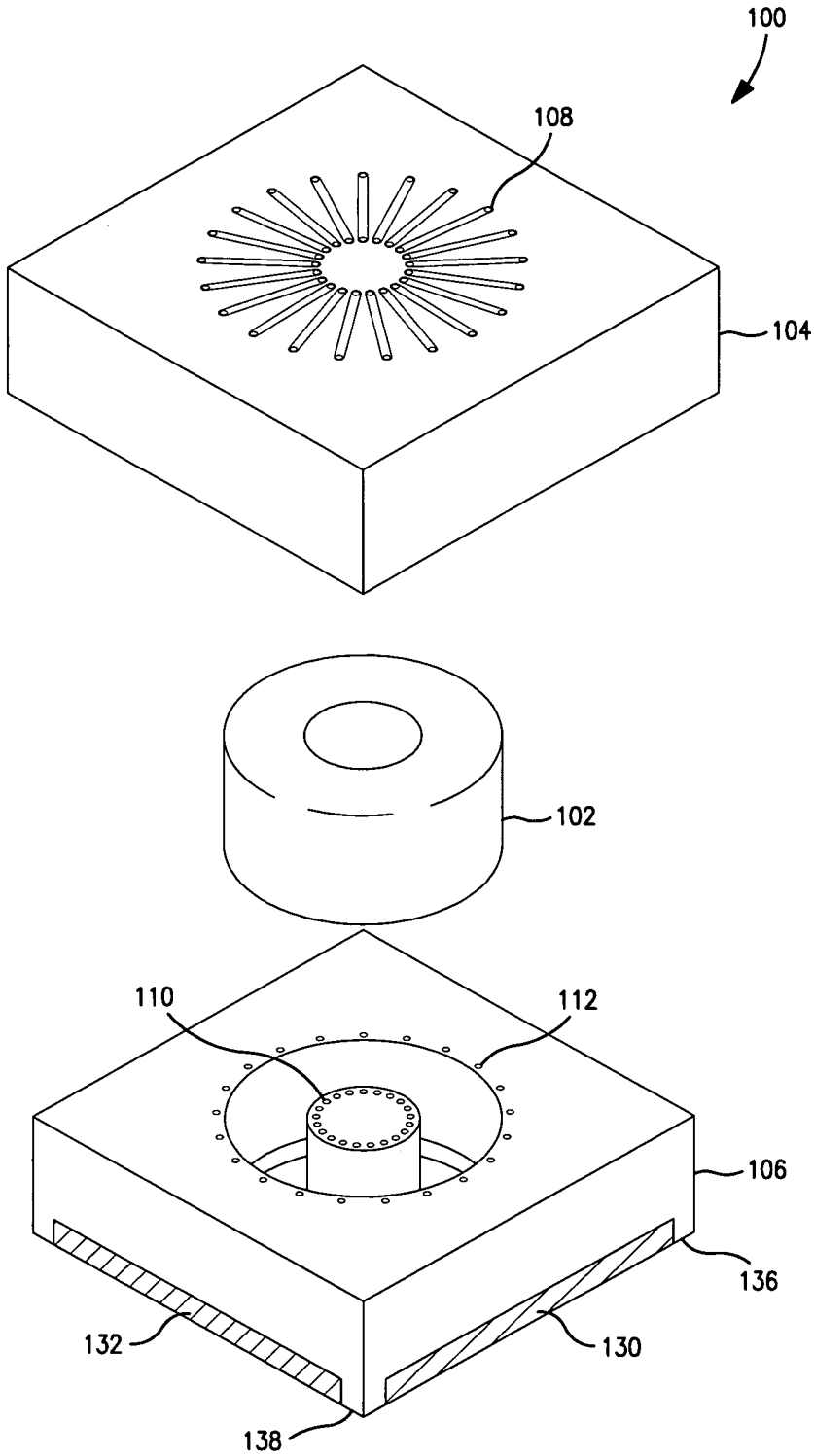
FIG. 1*f* is a front perspective exploded view a self-leaded inductive device manufactured in accordance with the principles of the present invention.

Referring now to FIG. 1*f*, yet another embodiment of an inductive device 100 manufactured in accordance with the principles of the present invention is shown and described in detail. In the present embodiment of FIG. 1*f*, the bottom header 106 utilizes two (2) plated pads 130, 132 in order to surface-mount the inductive device 100 to an external device (not shown). In effect the pads 130, 132 of the present embodiment make the inductive device 100 a self-leaded device. The pads 130, 132 act as an interface between the external device and the ends of the windings of the inductor. These pads will comprise plated tracing similar to that used with regards to e.g. the top windings 108 shown on the top header 104. The inductive device may then be surface mounted to an external device using well known soldering techniques (such as IR reflow) now ubiquitous in the electronic arts. While the present embodiment only shows two pads 130, 132, the invention is not so limited. In fact, any number of pads may be readily added by one of ordinary skill given the present disclosure herein. In addition, while the pads 130, 132 are shown as being placed on separate edges 136, 138 respectively of the device 100, it is recognized that these pads may just as easily be placed on a single edge or surface (such as edge 136). Further these pads 130, 132 may also reside on the bottom surface (not shown) either in part or in their entirety. These variations in pad layout being well within the knowledge of one of ordinary skill given the present disclosure provided herein.

Figure 1G:
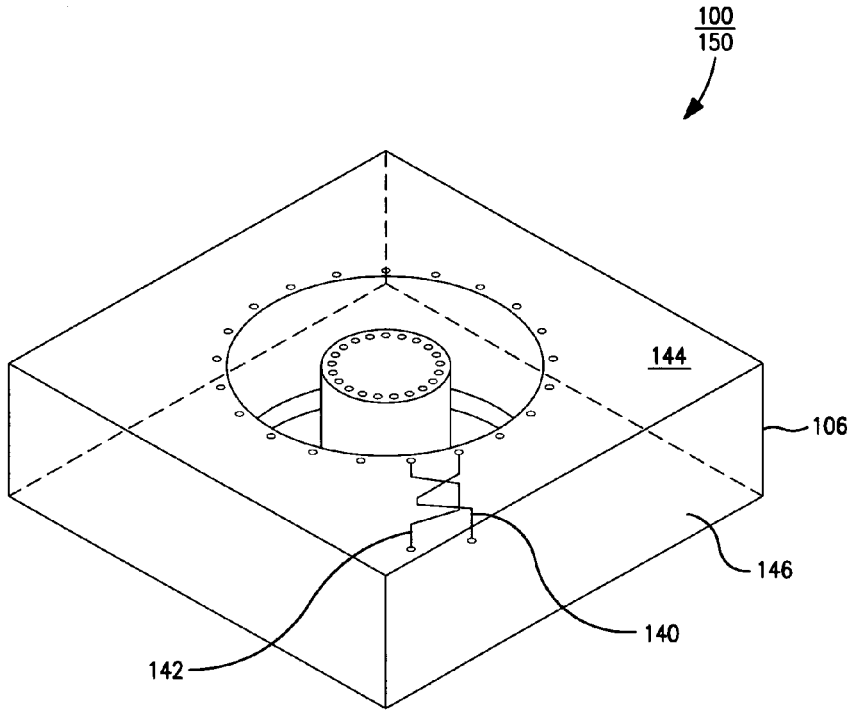
FIG. 1*g* is a front perspective view of a bottom header(s) comprising twisted pair vias manufactured in accordance with the principles of the present invention.

Referring now to FIG. 1*g*, still another embodiment of an inductive device 100, 150 is shown and described in detail. In the embodiment of FIG. 1*g*, twisted pair windings are implemented into one or more headers 106 of inductive device 100, 150. As is known in the prior art, twisted pair winding is a form of wiring in which two or more conductors are wound around each other for the purposes of canceling out electromagnetic interference ("EMI") from external sources and/or crosstalk between neighboring conductors. This can also provide capactive coupling. The twist rate of a winding (usually defined in twists per meter or twists per inch) makes up part of the specification for any given class of twisted pair winding. Generally, the greater the number of twists, the more that adverse electrical interference such as crosstalk is reduced. Twisting wires decreases interference because the loop area between the wires, which in turn determines the magnetic coupling introduced into the underlying signal. For example, in networking applications, there are often two conductors which carry equal and opposite signals which are combined by subtraction at the destination. The noise signals introduced or received onto the two wires cancel each other in this destination subtraction operation because the two wires have been exposed to similar levels of electromagnetic interference noise.

Similarly, the two "windings" can merely be run substantially parallel yet proximate one another to produce a desired degree of capacitive and/or electromagnetic coupling between them. This is true of any two or more traces on the device 100; by placing them in a desired disposition (e.g., parallel) and distance, a desired level of coupling between the windings can be accomplished. Moreover, this coupling approach can be used on multiple layers or levels of the device. See, e.g., the exemplary configuration of FIG. 1*j* discussed below.

As can be seen in FIG. 1*g*, adjacent vias 140, 142 will collectively form a twisted pair between the top surface 144 and the bottom surface of the header 106. At intermediate levels of the header 106 (or in embodiments where multiple headers are stacked), traces are formed which effectively 'spiral' about one another thereby forming the twisted pairs effect in the individual vias 140, 142. While primarily discussed with reference to a bifilar twisted pair, it can be seen that trifilar/quadfilar windings, etc. could be added to the inductive device 150 design. Such modifications and adaptation being within the skill of an ordinary artisan given the present disclosure provided herein.

Figure 1H:
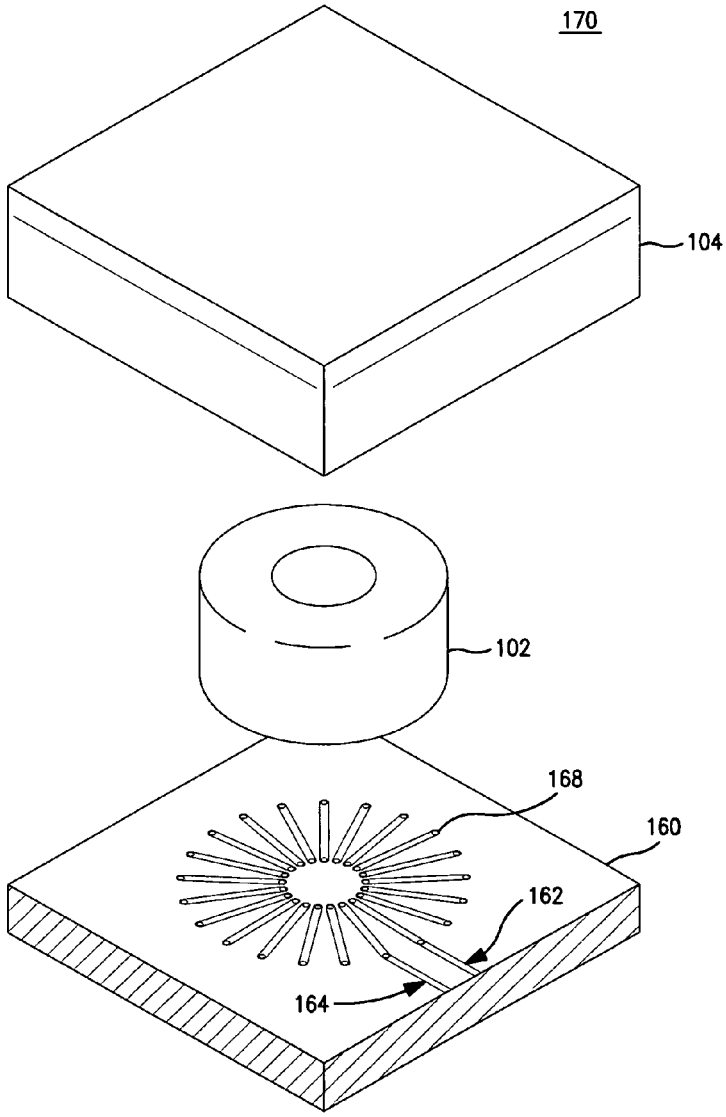
FIG. 1*h* is a front perspective exploded view of a single header inductive device embodiment manufactured in accordance with the principles of the present invention.

Referring now to FIG. 1*h*, a single-header inductive device 170 embodiment is shown and described in detail. As can be seen in FIG. 1*h*, the bottom windings 168 that were previously incorporated onto a bottom header are now implemented directly on the parent (e.g., customer's) printed circuit board 160. Input 162 and output 164 traces are routed between the inductive device 170 and other electronic components present on the circuit board 160. Top header 104 also demonstrates an embodiment where the windings (i.e. windings 108 on FIG. 1) are no longer visible or electrically exposed on the top surface of the inductive device 170. This can be accomplished by, e.g., depositing a layer of non-conductive material over the top surface of the header 104 after the windings 108 are formed. This "covered" approach allows the device 170 to be surface mounted using automated processes such as a pick-and-place machine without potentially causing damage to the underlying printed windings.

Figure 1I:
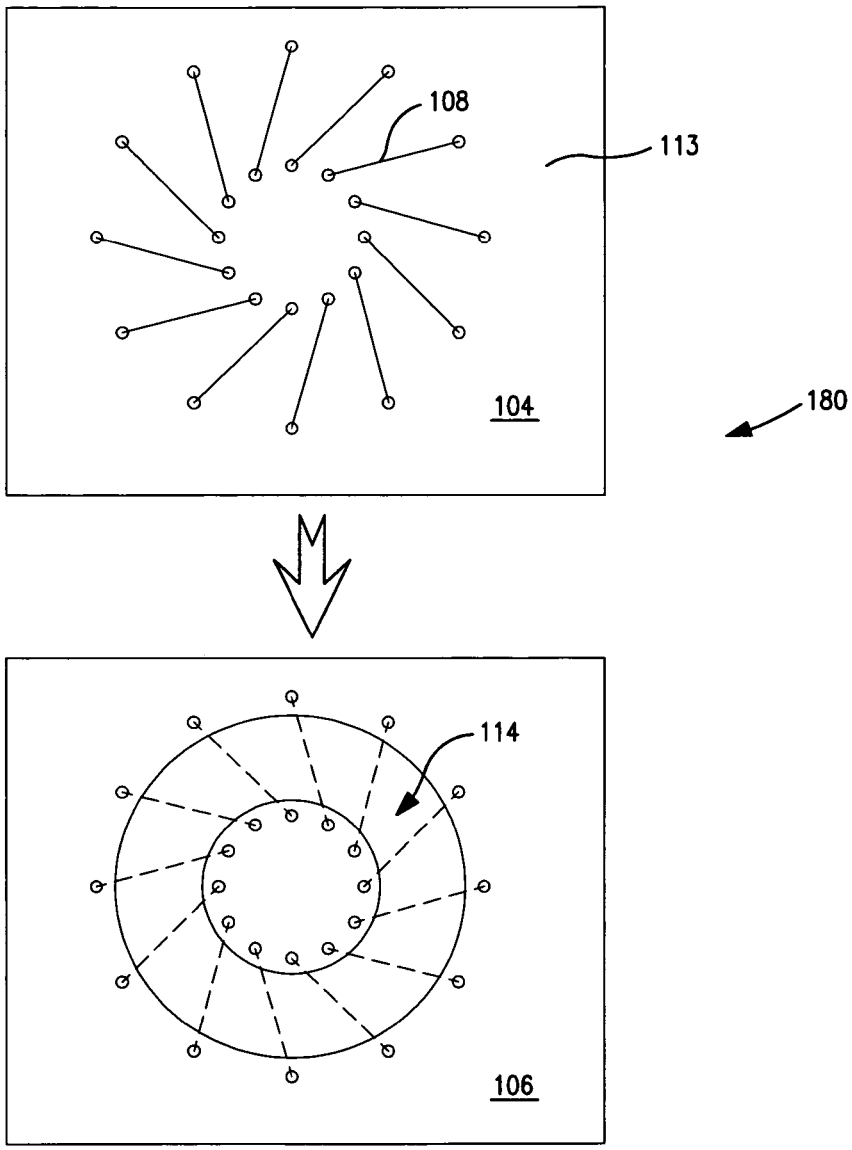
FIG. 1*i* is a top elevational view of an inductive device using two substantially identical headers.

As shown in FIG. 1*i*, yet another embodiment of the invention comprises two substantially identical headers 104, 106 that also have substantially identical winding portions 108 disposed on their respective outer surfaces 113, so that the finished (and printed) headers 104, 106 are substantially identical as well. This approach produces a set of interspersed or "inter-wound" windings, effectively comprising a loosely helical or bifilar arrangement. This approach has the advantage of being able to construct the resulting device 180 using headers which are identical; i.e., the top and bottom headers can be identical, thereby obviating the need for different components. This significantly reduces manufacturing cost, since there is no need to make stock and handle differing configurations of headers.

These substantially identical components as shown in FIG. 1*i* also have at least two degrees of achirality (i.e., non-handedness), thereby allowing them to be substantially orientation-agnostic during assembly. For example, a machine could place the "top" header in a random rotational (angular) orientation, and then place the second, bottom header in an inverted orientation, yet also random with respect to angle. If the headers 104, 106 are square in profile, then all that would be required is for the corners of the tops and bottom headers to align, thereby guaranteeing that the vias of each would align as well. This greatly improves manufacturing flexibility and reduces cost, since e.g., the machines used to manufacture these devices need only have sufficient intelligence to pick two headers, place one in inverted orientation to the other, and then align the corners.

It will further be appreciated that any of the foregoing embodiments of FIGS. 1-1*i* (and in fact others) can be rendered in the form of two or more toroids or cores in a common header. See, e.g., the approach shown in FIG. 2 (described below), wherein two cores are disposed in side-by-side fashion within a common header assembly. Similarly, the multi-core approach described herein can be applied to provide heterogeneous devices, such as where a single header is used to house both a common-mode choke and a transformer (or sets of the foregoing).

Figure 1J:
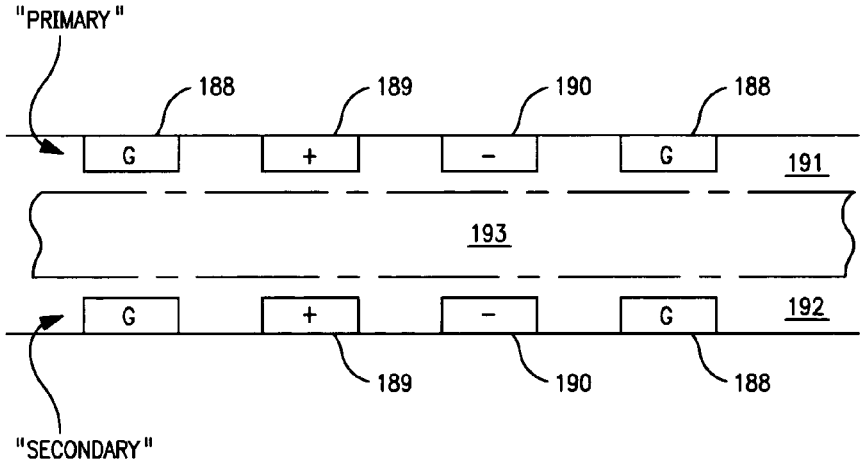
FIG. 1*j* cross-sectional view of yet another embodiment of the invention, wherein a plurality of winding traces are disposed proximate one another, yet in different layers of the header or associated substrate of the inductive device.

FIG. 1*j* illustrates yet another embodiment of the invention, wherein a plurality of winding traces are disposed proximate one another, yet in different layers of the header or associated substrate of the device 100. Such a configuration may be useful, e.g., for high-frequency coupling of signals. As shown in FIG. 1*j*, the ground (G) 188, positive (+) 189, and negative (−) 190 windings of a coupled transformer are disposed in different layers 191, 192 of the header or substrate (e.g., FR-4 PCB or the like) and separated by a dielectric 193. The windings and dielectric can then be used to form capacitive structures (e.g., two parallel "plates" separated by a dielectric), as well as providing inductive (magnetic) field coupling between the different windings.

Figure 2:
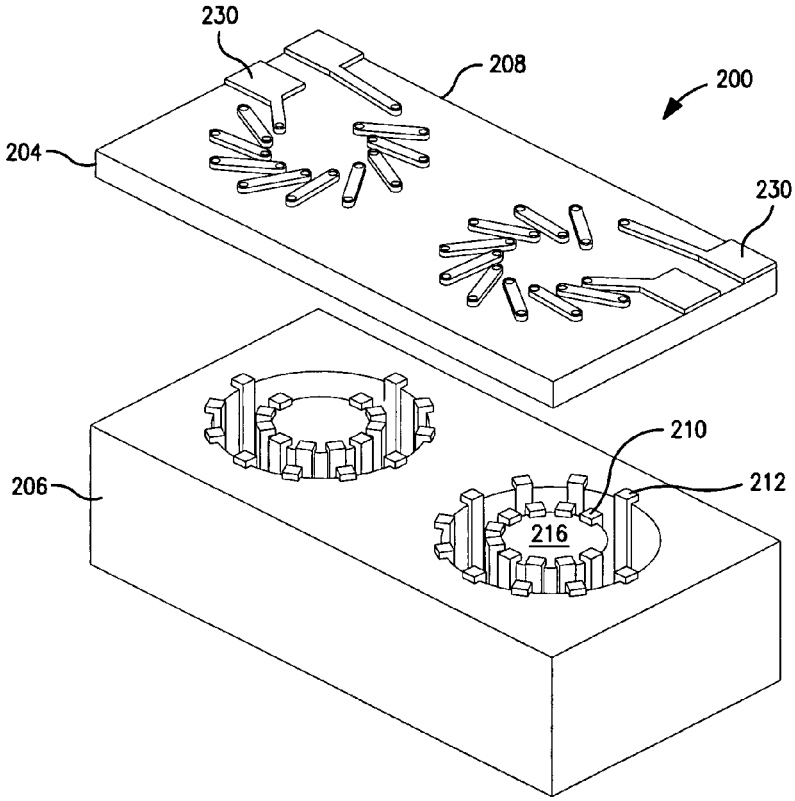
FIG. 2 is a front perspective exploded view of a multiple toroidal core inductive device manufactured in accordance with the principles of the present invention.

Referring now to FIG. 2, a multiple toroidal inductive device 200 utilizing a plurality of connection elements 210, 212 is shown and described in detail. In the present embodiment shown in FIG. 2, the multiple toroidal inductive device 200 comprises a header 206 that comprises a toroidal cavity 216 having a plurality of connection elements 210, 212. The multiple toroidal inductive device 200 also comprises a top substrate 204 which comprises a plurality of windings 208 and one or more electronic component receiving pads 230. In addition, the multiple toroidal inductive device 200, as is implied by the name of the device, comprises a plurality of magnetically permeable toroidal cores (not shown) such as that which has already been shown with regards to, for example, FIG. 1.

Top substrate 204 of the present embodiment demonstrates yet another advantage over prior art wound inductive devices. Namely, portions of the windings 208 for the inductive device 200 can be printed in combination with one or more electronic component receiving pads 230. These electronic component receiving pads 230 are then utilized to mount e.g. surface mountable electronic components (e.g. chip capacitors, resistors, integrated circuits and the like) between individual windings 208 of the toroidal inductive devices. This allows for integrated inductive devices 200 that utilize more then just toroidal cores and offer integrated customer solutions. For instance, many well known magnetic circuits utilized in, for example, Gigabit Ethernet circuit topologies utilize what is known in the industry colloquially as a "Bob Smith" termination. These terminations typically utilize a plurality of resistors tied in parallel to a grounded capacitor. By offering mounting locations for these circuit elements directly onto the substrate header 204, an integrated magnetics solution can be provided for a minimal addition of cost.

While the embodiment of FIG. 2 only shows cavities 216 for two (2) magnetically permeable toroids, three (3) or more magnetically permeable toroids can readily be incorporated into the design if desired. In addition, features discussed with regards to FIGS. 1*b*-1*h* could readily be incorporated into the inductive device 200 of FIG. 2 if desired by one of ordinary skill given the present disclosure and vice versa.

Figure 2A:
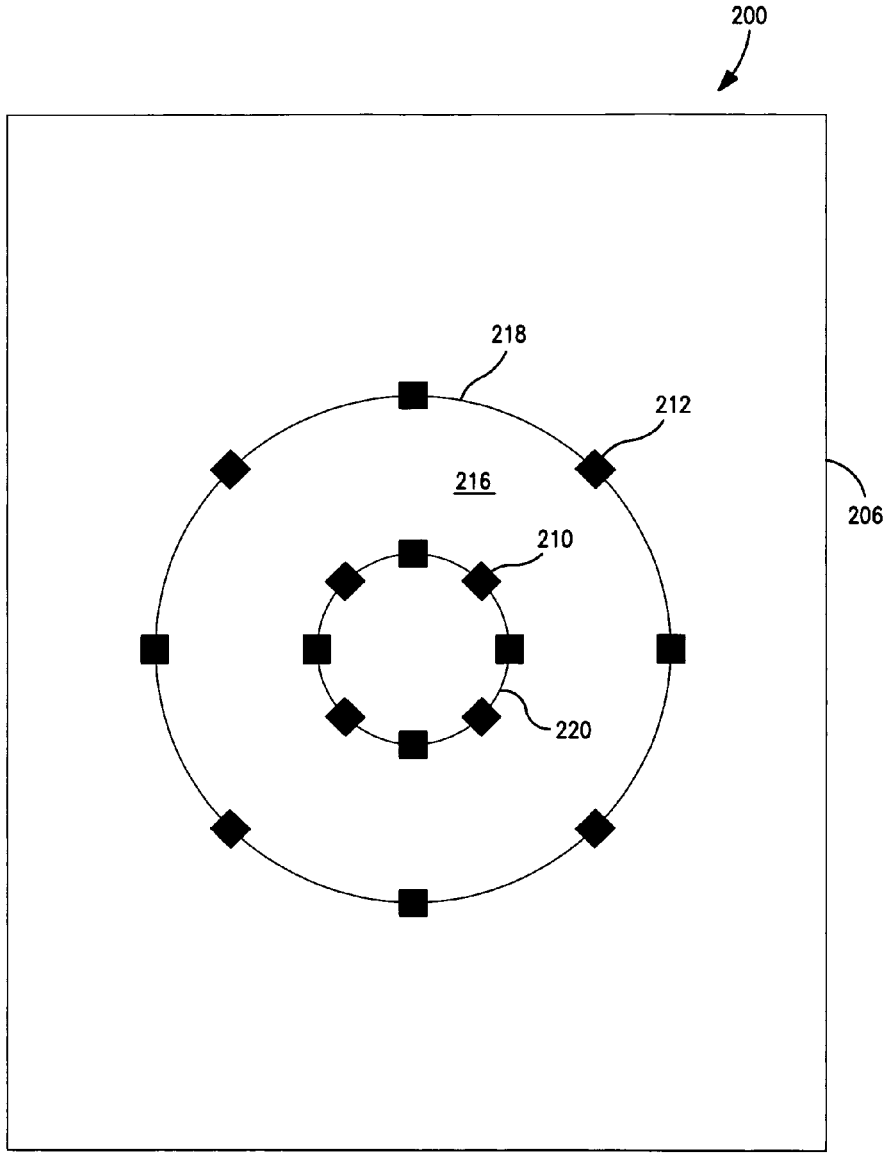
FIG. 2*a* is a top view of a cavity of the connection insert inductive device of FIG. 2 manufactured in accordance with the principles of the present invention.

Referring now to FIG. 2*a*, a single cavity 216 of the header 206 is shown and described in detail. While the inductive device 200 of FIGS. 2 and 2*a* may readily incorporate the connecting vias shown and described with regards to FIGS. 1-1*i*, the present embodiment of FIGS. 2-2*a* incorporates plated connection elements 210, 212 on both the inner 220 and outer 218 diameters of toroidal cavity 216. Each connection element 210, 212 preferably comprises a metallized or plate-able polymer material. One such metallized polymer material comprises a metallized ABS plastic. Other materials might include without limitation PCABS, Syndiotactic Polystyrene (SRS), etc. Electro-less or electrolytic metallization processes, or yet other processes know to those of ordinary skill in the art, can be used for this purpose as well.

In one variant, the element 210 is first etched chemically by a suitable process, such as dipping in a hot chromic acid-sulfuric acid mixture. The etched surface is then sensitized and activated by dipping in a tin chloride solution, followed by a palladium chloride solution. This processed surface can then be coated with an electro-less copper or nickel material. After plating, the element 218 may then be optionally inserted into the header 206 and subsequently plated using well known eutectic solders ubiquitous in the electronic arts if desired. Other techniques prevalent in the metallizing arts may also be used if desired. The process of metallizing generally refers to any process which coats a metal onto a non-metallic object.

In another variant (FIG. 2*b*), the connection elements are formed by depositing the plate-able material (e.g., ABS) 225 within the channels 223 formed in the header 206. For example, once the channels are formed in the header (e.g., at time of formation of the header), an injection molding or other comparable process can be used to deposit the plate-able material into the channels 223.

Figure 2B:
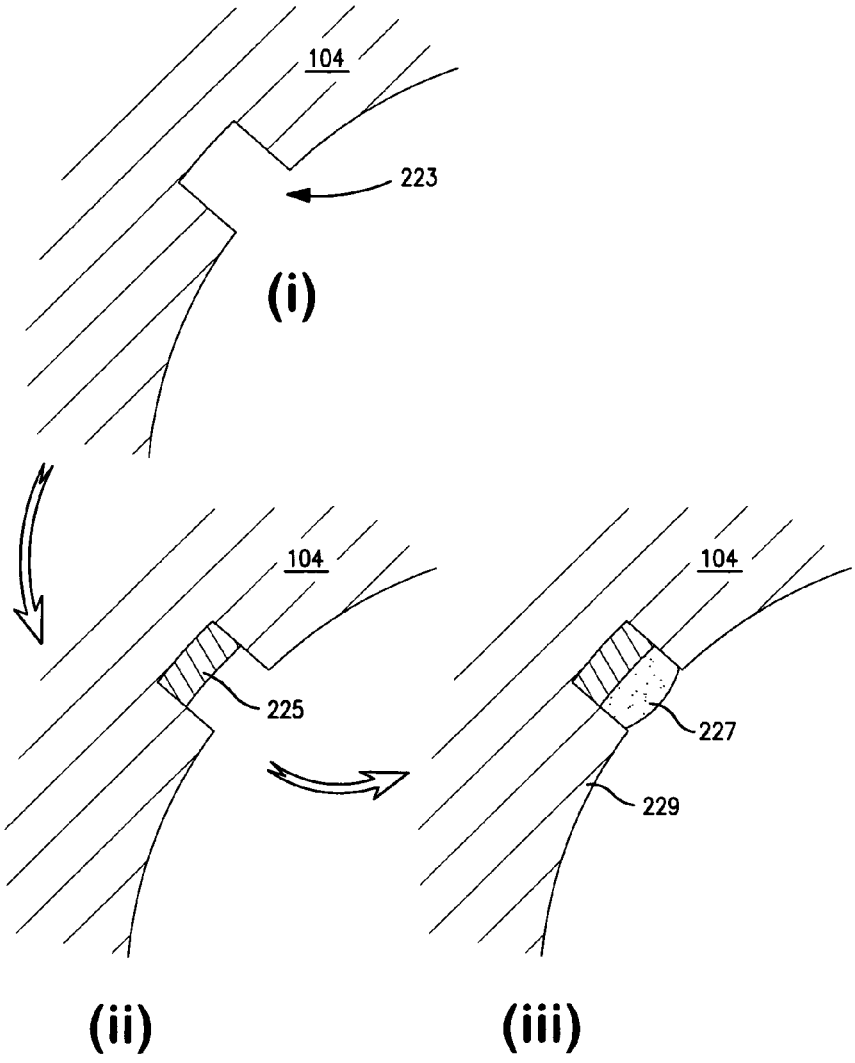
FIG. 2*b* is a partial top plan view of another embodiment of the inductive device of the present invention, showing use of a plate-able material to form conductive pathways.

This plate-able material (which may be plate-able after deposition, or after further chemical processing of the type previously described) acts as a foundation for a subsequent plating layer of conductive material 227, the latter which forms the electrical pathway through the channel 223 to form the winding "turn". As shown in FIG. 2*b*, the sides of the channel 223, which are not formed from a plate-able material in this embodiment, act as a form or guide for building up the conductive plate 227 to a desired height within the channel 223 (which may range anywhere from below the surface of the toroid cavity wall 229, to extending above it; e.g., in an outwardly convex manner as shown in FIG. 2*b*). Different profiles for the plated material may be used as well, e.g., convex, linear (flat), concave, asymmetric, and so forth. The advantage of the exemplary process of FIG. 2*b* is that the plating material only builds up and forms in the channels 223, and nowhere else (since a non-plate-able header material is used).

It will also be appreciated that the channels 223 may be shaped according to any number of different profiles, and may also be coated with other materials before or after the placement of the plate-able material as previously described. For example, the channels might comprise, instead of the square or rectangular cross-section shown in FIG. 2*a*, a rounded or semi-circular profile. Alternatively, a wedge or chevron-shaped profile might be used. As another option, the outermost (measured radially from the center of the toroid) wall of the channel might be convext or concave. As yet another alternative, the channels may be in the form of vias (e.g., fully enclosed channels having a substantially circular, oval, square, etc. cross-section, more akin to the embodiment of FIG. 1). Many different profiles will be recognized by those of ordinary skill, such profiles being selected to achieve a particular design feature or goal.

In another embodiment, the channel walls may be treated with a chemical or process to cause the injected polymer to change its adherence properties, to affect how the plating process interacts with the channels walls, and so forth.

In yet another embodiment, the aforementioned "via" channels are injection-molded or otherwise at least partly filled with a plate-able material (e.g., ABS, etc. as noted above), thereby forming in effect an inner sleeve. The interior and end surfaces of the plate-able material are then subsequently plated, with the plating material adhering or forming only to the plate-able element. Accordingly, a plated sleeve is formed within the non-plated header.

Figure 1K:
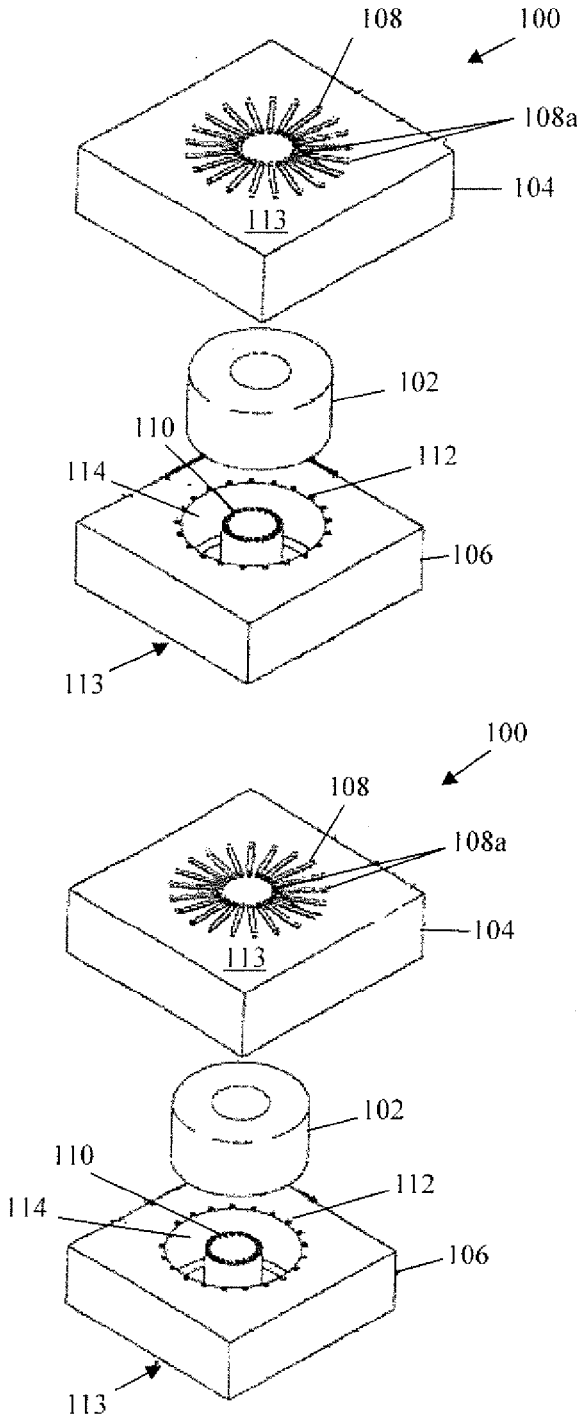
FIG. 1*k* is a front perspective exploded view illustrating a first embodiment of a pair of wire-less toroidal inductive devices stacked in a substantially vertical fashion in accordance with the principles of the present invention.

In still another embodiment (FIG. 1*k*), any of the aforementioned inductive devices may be stacked in a vertical fashion; e.g., so that the planes of each toroid core are substantially parallel yet not co-extensive. To this end, discrete devices (e.g., top, bottom header and core) can be stacked upon one another, with appropriate electrical (inter)connections or terminations provided for each. This approach can be used to, for example, economize on footprint where two or more devices are required. Due to the highly regular and square/rectangular shape of the exemplary device, this "stacking" can be performed in a highly space efficient manner, akin to stacking boxes in a warehouse (with little or no wasted space between them).

In still another embodiment, the "via" channels 223 can be filled using a conductive adhesive or substantially flowable material (e.g., Gold flake in silicone, etc.). In this fashion, the flowable material can be pressurized and injected into the via channels (or alternatively vacuum drawn into the channels) in order to form the conductive pathway (e.g., part of the core "winding") as previously described. To this end, an aperture or other fixture with the desired diameter can be positioned over one or both ends of the via channel in order to provide the desired flow and disposition of material within the channel.

Figure 2C:
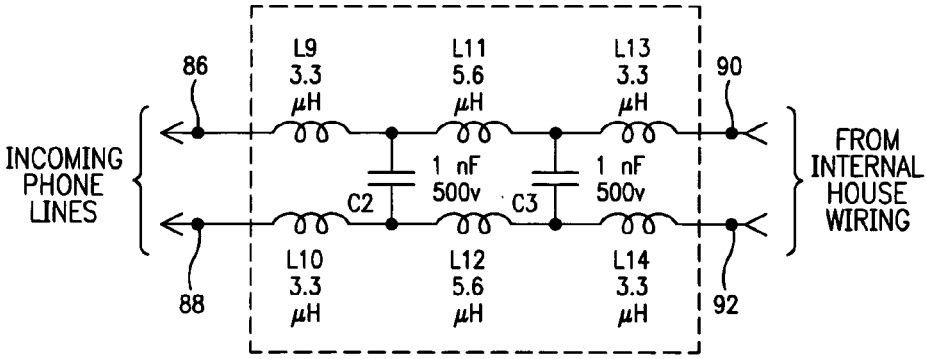
FIG. 2*c* is a schematic of an exemplary DSL filter circuit that can be formed using the inductive device of the present invention.

Moreover, as previously referenced, other electrical components can be disposed on various surfaces of the header(s) 104, 106 so that these other components can be used to form a circuit with the inductive device. For example, a simple DSL filter (a plurality of inductors, capacitors, and resistors arranged in "stages" can be formed on the multi-core device of FIG. 2. Similarly, the exemplary circuit of FIG. 2*c* can be formed on a self-leaded, quad-core device (not shown) by, e.g., disposing the additional capacitors and inductors on the upper surface of the top header 104, peripheral to the winding portions 108. This approach puts these other filter circuit components in convenient and direct proximity to the terminations of the inductive devices.

Additionally, the printed or otherwise formed traces 108 on the header(s) 104, 106 can also be intentionally varied in width, shape, thickness, or other properties (such as alloy composition, electrical resistance, routing path, etc.) in order to control the electrical or mechanical properties of the device. For example, the thickness of a portion of the trace can be reduced in order to create more surface effect, and hence internal heating and resistance in the conductor as a whole.

In another embodiment of the device 100, 200, other passive or active electronic components can be embedded with the header material as well. For example, chip capacitors, resistors, etc. can be embedded with the LTCC or FR-4 previously described, so as to be used in circuitry along with the inductive device (e.g., in a DSL filter or other multi-component circuit).

Wire-Less Non-Toroidal Inductive Devices

Figure 3:
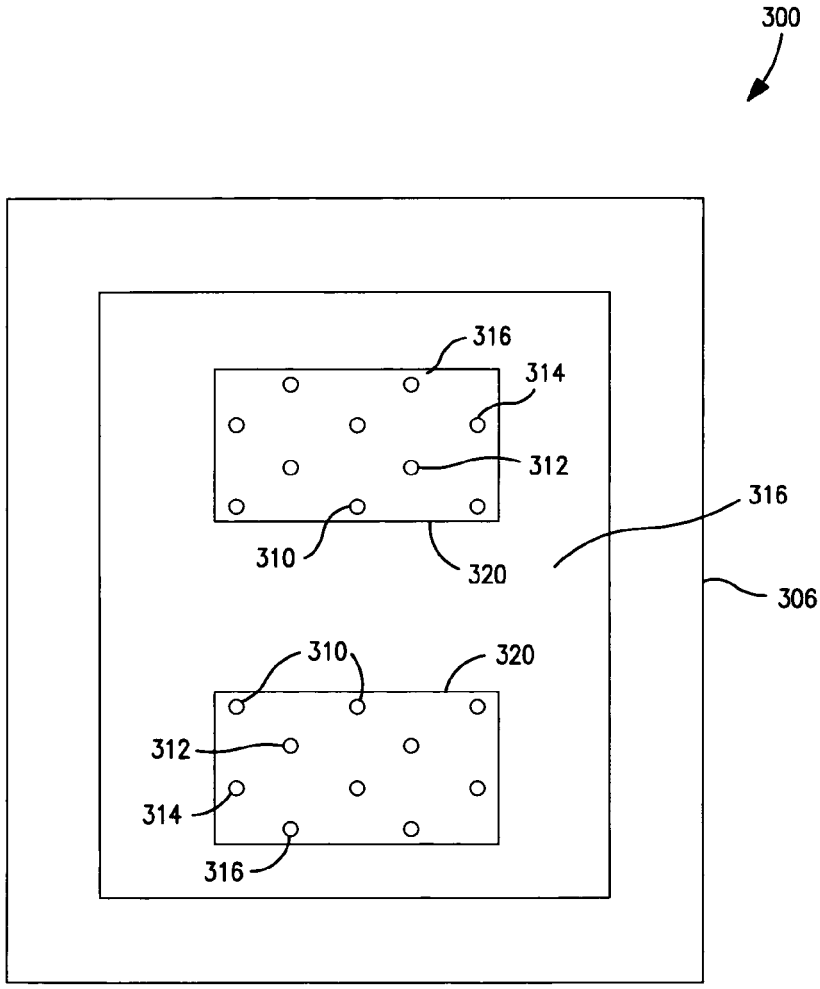
FIG. 3 is a top view of a bottom header of an E-core inductive device manufactured in accordance with the principles of the present invention.

Referring now to FIG. 3, a wire-less non-toroidal inductive device 300 is shown and described in detail. The inductive device 300 shown comprises a cavity 316 adapted to receive a magnetically permeable core (not shown) that is not toroidal in shape. Specifically the inductive device of FIG. 3 is adapted to receive an E-type core ubiquitous in the electronic arts. In the header 306 of the inductive device 300, posts 320 comprise a plurality of vias 310, 312, 314, 316. These vias would be routed to one another using a top header (not shown) similar in construction to those embodiments described with regards to FIGS. 1-2*a*.

While an E-type core cavity 316 is shown in the inductive device 300 of FIG. 3, various core shapes ubiquitous in the electronic arts may be readily utilized with appropriate adaptation to the header 306. For instance, various core types such as: (1) cylindrical rods; (2) "C" or "U" type cores; (3) variations of the "E" core such as an EFD or ER style core; and (4) pot cores could be utilized with minor adaptations. However, it is recognized that toroidal cores, such as those described with regards to FIGS. 1-2*a* above, have many advantages as a result of the geometry of the toroidal core. Namely, the toroidal geometry provides the inductive device with an efficient and low radiation device.

Exemplary Inductor or Inductive Device Applications

Inductors and inductive devices, such as those previously disclosed with regards to FIGS. 1-3, can be used extensively in a variety of analog and signal processing circuits. Inductors and inductive device in conjunction with capacitors and other components form tuned circuits which can emphasize or filter out specific signal frequencies (e.g., DSL filters). The present embodiments disclosed with regards to FIGS. 1-3 previously discussed may readily be adapted for any number differing inductor or inductive device applications. These applications can range from the use of larger inductors for use in power supplies, to smaller inductances utilized to prevent radio frequency interference from being transmitted between various devices in a network. The inductors or inductive devices of the present invention may also be readily adapted for use as common-mode choke coils or inductive reactors which are useful in a wide range of prevention of electromagnetic interference (EMI) and radio frequency interference (RFI) applications.

Smaller inductor/capacitor combinations can also be utilized in tuned circuits used in radio reception and/or broadcasting. Two (or more) inductors which have a coupled magnetic flux (such as those embodiments discussed with regards to FIGS. 1*d* and 1*e*) may form a transformer which is useful in applications that require e.g. isolation between devices. The inductors and inductive devices of the present invention may also be employed in electrical power and/or data transmission systems, where they are used to intentionally depress system voltages or limit fault current, etc. Inductors and inductive devices, and their applications, are well known in the electronic arts and as such will not be discussed further herein.

In another aspect, the apparatus and methods described herein can be adapted to forming components for miniature motors, such as a miniature squirrel-cage induction motor. As is well known, such an induction motor uses a rotor "cage" formed of substantially parallel bars disposed in a cylindrical configuration. The vias and winding portions 108 previously described may be used to form such a cage, for example, and or the field windings (stator) of the motor as well. Since the induction motor has no field applied to the rotor windings, no electrical connections to the rotor (e.g., commutators, etc.) are required. Hence, the vias and winding portions can form their own electrically interconnected yet electrically separated conduction path for current to flow within (as induced by the moving stator field).

Methods of Manufacture

Methods of manufacturing of the inductive devices described above are now described in detail. It is presumed for purposes of the following discussion that the headers 104, 106 are provided by way of any number of well known manufacturing processes including e.g., LTCC co-firing, formation of multi-layer fiber-based headers, etc., although these materials and formation processes are in no way limiting on the invention.

It will also be recognized that while the following descriptions are cast in terms of the embodiments previously described herein, the methods of the present invention are generally applicable to the various other configurations and embodiments of inductive device disclosed herein with proper adaptation, such adaptation being within the possession of those of ordinary skill in the electrical device manufacturing field.

Figure 4A:
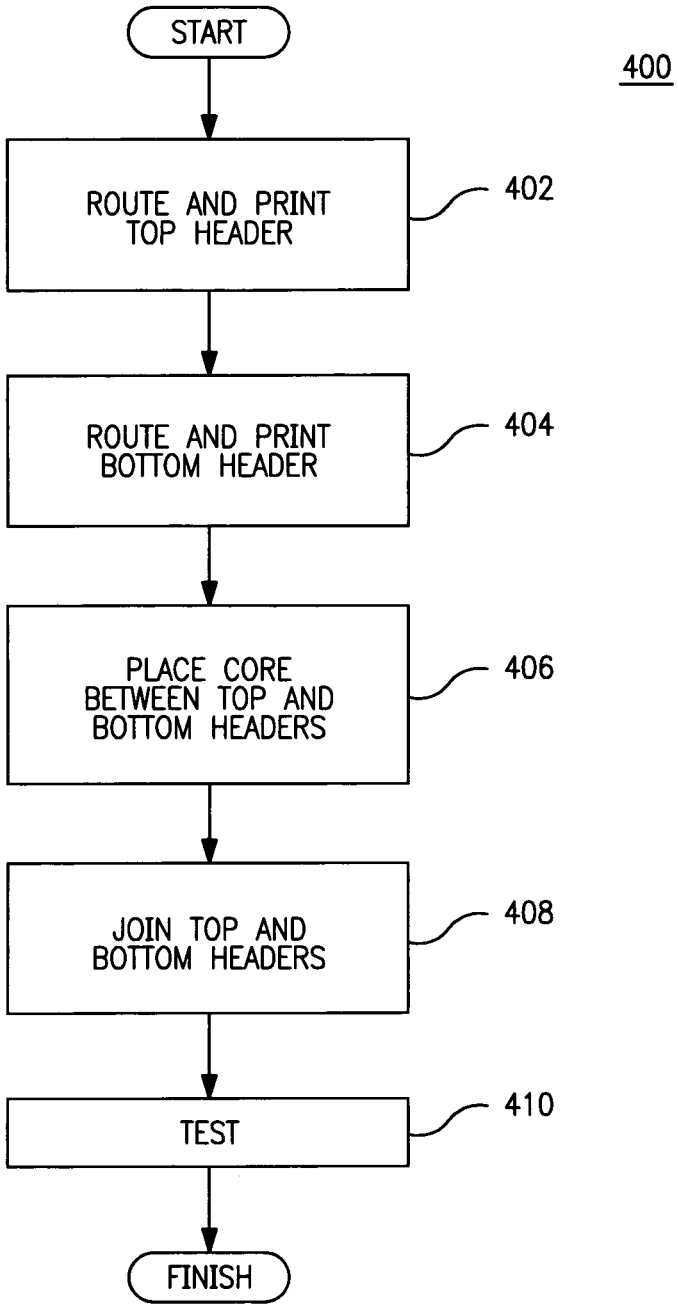
FIG. 4*a* is a logical flow diagram illustrating a first exemplary method for manufacturing a wire-less inductive device produced in accordance with the principles of the present invention.

Referring now to FIG. 4*a*, a first exemplary method 400 of manufacturing a wire-less inductive device (such as that shown in FIG. 1) is shown and described in detail. In step 402, the top header is routed and printed in order to form the top portion of the windings for the inductive device. The routing and printing of substrates, such as fiber-glass based substrates, are well known. In a first exemplary process for the routing and printing of the top header, vias are typically drilled with tiny drill bits made of solid tungsten carbide or another suitable material. The drilling is typically performed by an automated drilling machine which places the vias in precise locations. In certain embodiments where very small vias are required, drilling with mechanical bits can be costly due to high rates of wear and breakage. In these cases, the vias may be 'evaporated' via the use of lasers as is well-known in the art. The walls of these drilled or formed holes, for substrates with 2 or more layers, are then plated with copper or another material or alloy to form plated-through holes that electrically connect the conducting layers of the header substrate thereby forming the portions of the windings resident between the top and bottom surface of the header. The top windings 108 can be printed using any number of well-known additive or subtractive processes. The three most common of the subtractive processes utilized are: (1) silk screen printing which typically uses an etch-resistant ink to protect the copper plating on the substrate—subsequent etching processes remove the unwanted copper plating; (2) photoengraving, which uses a "photo mask" and a chemical etching process to remove the copper foil from the substrate; and (3) PCB milling, that uses a 2 or 3 axis mechanical milling system to mill away the copper layers from the substrate, however this latter process is not typically used for mass produced products. So-called additive processes can also be utilized. These processes are well known to those of ordinary skill and readily applied in the present invention given this disclosure, and as such will not be discussed further herein.

In step 404, the bottom header is routed and printed, similar to those processing steps discussed with regards to step 402 above. At step 406, the core is placed between the top and bottom headers.

At step 408, the top and bottom headers are joined thereby forming windings about the placed core. Several possibilities for the joining of the top and bottom headers exist. One exemplary method comprises adding ball grid array ("BGA") type solder balls on the inner and outer vias of e.g. the bottom header. The top header will then be placed and clamped on top of the bottom header and a solder reflow process such as an IR reflow process will be utilized to join the top and bottom headers. For example, a stencil print process and reflow can be used, as could an ultrasonic welding technique, or even use of conductive adhesives (thereby obviating reflow).

At step 410, the joined assembly is tested to ensure that proper connections have been made and the part functions as it should.

Figure 4B:
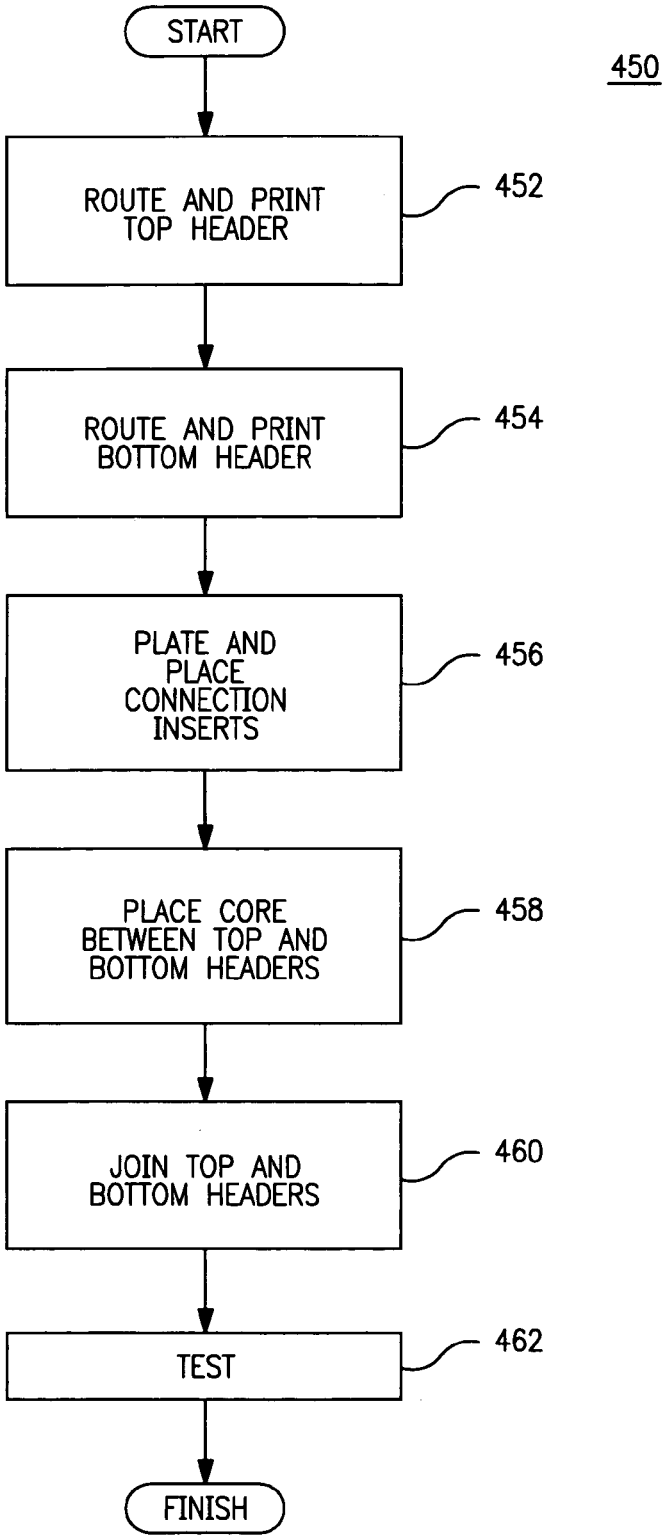
FIG. 4*b* is a logical flow diagram illustrating a second exemplary method for manufacturing a wire-less inductive device produced in accordance with the principles of the present invention.

Referring now to FIG. 4*b*, a second exemplary method 450 of manufacturing a wire-less inductive device is shown and described in detail. At step 452, the top header is routed and printed similar to step 402 previously discussed above with the exception that plated through hole vias are not utilized. In addition to those processes already discussed above, geometry of the top header may also be advantageously formed using a punch and the like. In a case where a ceramic substrate is utilized, the manufacturing process may comprise any number of well known sintering processes. At step 454, the bottom header is routed using similar processes as those utilized with respect to step 452 above.

At step 456, connection elements (such as those shown and described with regards to FIGS. 2-2*a*) are metallized using well known processes. The connection elements are then placed within either or both of the header substrates. Optionally, a eutectic solder is added to the connection inserts in order to more fully form this portion of the windings for the inductive device. Adhesive solder or other such materials may be used as well.

At step 458, the core is placed between the top and bottom headers and at step 460 these headers are joined. The joined headers are then further processed if needed (e.g., IR reflowed, ultrasonic welded, etc.)

At step 462, the assembly is optionally tested and is then ready for mounting on a customer's product such as a printed circuit board within a communications system, etc.

Figure 4C:
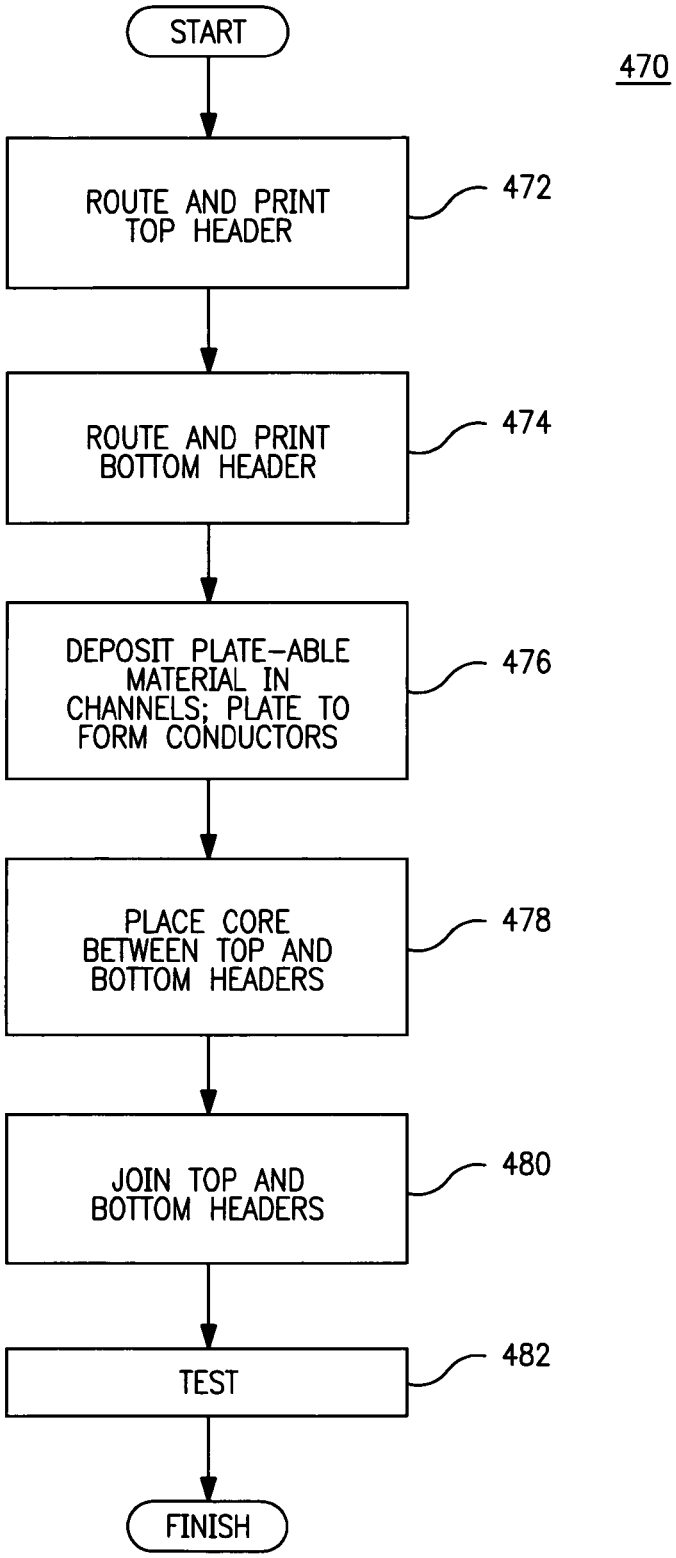
FIG. 4*c* is a logical flow diagram illustrating a third exemplary method for manufacturing a wire-less inductive device produced in accordance with the principles of the present invention.

Per FIG. 4*c*, yet another embodiment of the method 470 of manufacturing is described. At step 472, the top header is routed and printed similar to step 402 previously discussed above with the exception that plated through hole vias are not utilized. In addition to those processes already discussed above, geometry of the top header may also be advantageously formed using a punch and the like. In a case where a ceramic substrate is utilized, the manufacturing process may comprise any number of well known sintering processes. At step 474, the bottom header is routed using similar processes as those utilized with respect to step 472 above.

At step 476, the connection elements (such as those shown and described with regards to FIG. 2*b*) are formed by first depositing a plate-able material (e.g., ABS) into the channels 423 of the bottom header. The connection elements are then plated or metallized so as to form the conductive pathways 227 as shown in FIG. 2*b* (iii).

This can also be repeated for the top header if the device is so configured.

At step 478, the core is placed between the top and bottom headers and at step 480 these headers are joined.

At step 482, the assembly is optionally tested and is then ready for mounting on a customer's product such as a printed circuit board within a communications system, etc.

It will further be appreciated that the exemplary devices 100, 200 described herein are amenable to mass-production methods. For example, in one embodiment, a plurality of devices are formed in parallel using a common header material sheet or assembly. These individual devices are then singulated from the common assembly by, e.g., dicing, cutting, breaking pre-made connections, etc. In one variant, the top and bottom headers 104, 106 of each device are formed within common sheets or layers of, e.g., LTCC or FR-4, and the termination pads are disposed on the exposed bottom or top surfaces of each device (such as via a stencil plating or comparable procedure). The top and bottom header "sheets" are then immersed in an electroplate solution to plate out the vias, and the winding portions 108 formed on all devices simultaneously. The toroid cores are then inserted between the sheets, and the two sheets reflowed or otherwise bonded as previously described, thereby forming a number of devices in parallel. The devices are then singulated, forming a plurality of individual devices. This approach allows for a high degree of manufacturing efficiency and process consistency, thereby lowering manufacturing costs and attrition due to process variations.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An inductive device, comprising:

a plurality of substrates, said substrates collectively having a plurality of conductive pathways formed therein comprised of a first conductive pathway and a second conductive pathway, each of said plurality of conductive pathways defined by a plurality of vias comprised of a plurality of outer vias and a plurality of inner vias; and a plurality of magnetically permeable cores comprising a first magnetically permeable core and a second magnetically permeable core, said cores disposed at least partly between said plurality of substrates;

wherein said magnetically permeable cores are stacked in a substantially vertical fashion such that at least a portion of said magnetically permeable cores are substantially parallel yet not co-extensive; and wherein said first magnetically permeable core is associated with said first conductive pathway and said second magnetically permeable core is associated with said second conductive pathway, said first and second conductive pathways being distinct from one another.

2. The inductive device of claim 1, wherein said inductive device comprises a plurality of transformers, and said magnetically permeable cores comprise a toroidal shape situated about a central axis, said toroidal shape further comprising an outer and an inner radial diameter extending radially from said central axis.

3. The inductive device of claim 2, wherein at least a portion of said plurality of conductive pathways comprises an outer winding diameter and an inner winding diameter, said outer winding diameter being larger then said outer radial diameter and said inner winding diameter being smaller than said inner radial diameter.

4. The inductive device of claim 3, wherein said plurality of conductive pathways collectively comprise a plurality of traces disposed on at least two total surfaces of said plurality of substrates.

5. The inductive device of claim 4, wherein said first conductive pathway comprises at least two windings, said at least two windings comprising a uniform pitch spacing.

6. The inductive device of claim 3, wherein said outer winding diameter comprises a first outer winding diameter and a second outer winding diameter and said inner winding diameter comprises a first inner winding diameter and a second inner winding diameter, said first and second outer and inner winding diameters each being unequal in radial diameter.

7. The inductive device of claim 1, wherein at least one of said plurality of substrates comprises a plurality of plated pads, said plurality of plated pads adapted for surface mounting said inductive device to an external substrate.

8. The inductive device of claim 1, wherein said plurality of conductive pathways are disposed so as to be orientation-agnostic during assembly.

9. A multiple core inductive device, comprising:

a plurality of substrates comprising a pair of outer substrates and one or more inner substrates, said substrates having a plurality of conductive pathways, said plurality of conductive pathways defined by a plurality of vias comprised of a plurality of outer vias and a plurality of inner vias; and a plurality of magnetically permeable cores, said plurality of cores each disposed at least partly between adjacent ones of each of said plurality of substrates;

wherein a first one of said plurality of magnetically permeable cores has a first conductive pathway associated therewith and a second one of said plurality of magnetically permeable cores has a second conductive pathway associated therewith, said first and second conductive pathways being distinct from one another.

10. The multiple core inductive device of claim 9, wherein at least one of said plurality of substrates further comprises one or more electronic component receiving pads.

11. The multiple core inductive device of claim 9, wherein each of said plurality of magnetically permeable cores comprises a toroidal shape situated about a respective central axis; and wherein each said toroidal shape further comprises an outer and an inner radial diameter extending radially from said respective central axis.

12. The multiple core inductive device of claim 11, wherein at least a portion of said plurality of conductive pathways associated with a first of said toroidal shapes comprises an outer winding diameter and an inner winding diameter, said outer winding diameter being larger then said outer radial diameter of said first of said toroidal shapes and said inner winding diameter being smaller than said inner radial diameter of said first of said toroidal shapes.

13. The multiple core inductive device of claim 12, wherein said plurality of conductive pathways collectively comprise a plurality of traces disposed on at least two total surfaces of said plurality of substrates and a plurality of conductive vias disposed within said plurality of substrates.

14. The multiple core inductive device of claim 9, wherein at least one of said plurality of substrates comprises a plurality of plated pads, said plurality of plated pads adapted for surface mounting said multiple core inductive device to an external substrate.

* * * * *